US011116297B1

(12) United States Patent
Latham et al.

(10) Patent No.: US 11,116,297 B1
(45) Date of Patent: Sep. 14, 2021

(54) MODULAR TABLESCAPE CARRYING CASE

(71) Applicant: Social Studies 101, LLC, Brooklyn, NY (US)

(72) Inventors: Jessica Latham, Brooklyn, NY (US); Amy Griffin, New York, NY (US)

(73) Assignee: SOCIAL STUDIES 101, LLC, Brooklyn, NY (US)

( * ) Notice: Subject to any disclaimer, the term of this patent is extended or adjusted under 35 U.S.C. 154(b) by 0 days.

(21) Appl. No.: 16/899,998

(22) Filed: Jun. 12, 2020

(51) Int. Cl.

| | |
|---|---|
| ***A45C 5/04*** | (2006.01) |
| ***A45C 5/02*** | (2006.01) |
| ***A45C 5/03*** | (2006.01) |
| ***A45C 11/20*** | (2006.01) |
| ***B65D 77/04*** | (2006.01) |
| ***B65D 81/05*** | (2006.01) |
| ***A45F 3/46*** | (2006.01) |
| ***A45C 13/02*** | (2006.01) |
| ***B65D 81/02*** | (2006.01) |
| ***B65D 85/30*** | (2006.01) |
| *B65D 81/38* | (2006.01) |

(52) U.S. Cl.

CPC ..... *A45C 5/04* (2013.01); *A45C 5/02* (2013.01); *A45C 5/03* (2013.01); *A45C 11/20* (2013.01); *A45C 13/02* (2013.01); *A45F 3/46* (2013.01); *B65D 77/0446* (2013.01); *B65D 81/02* (2013.01); *B65D 81/051* (2013.01); *B65D 85/30* (2013.01); *A45C 2005/037* (2013.01); *B65D 81/3825* (2013.01); *B65D 2577/047* (2013.01)

(58) Field of Classification Search

CPC ... A45C 11/20; A45C 13/02; A45C 2013/026; A45F 3/26; B65D 77/0446; B65D 81/3825; B65D 2577/042–047; B65D 81/051; B65D 81/05; B65D 81/107; B65D 81/1075; B65D 81/127; B65D 81/1275; B65D 25/04; B65D 85/44; B65D 85/30

USPC ..... 206/541, 545, 542, 546, 553, 426, 499; 220/23.88, 505, 507

See application file for complete search history.

(56) References Cited

U.S. PATENT DOCUMENTS

| | | | | | |
|---|---|---|---|---|---|
| 650,786 | A | * | 5/1900 | West | B65D 1/36 206/541 |
| 1,220,159 | A | * | 3/1917 | Labadie et al. | A45C 11/20 206/543 |
| 1,458,679 | A | * | 6/1923 | Bishop | A45C 11/20 126/261 |
| 2,425,963 | A | * | 8/1947 | Silva | A45C 11/20 206/543 |
| 2,465,910 | A | * | 3/1949 | Mills | A45C 11/20 206/544 |
| 2,627,970 | A | * | 2/1953 | Perkins | A45C 11/20 312/284 |
| 2,672,232 | A | * | 3/1954 | Kessell, Jr. | A45C 11/20 206/543 |

(Continued)

*Primary Examiner* — James N Smalley
*Assistant Examiner* — Jennifer Castriotta
(74) *Attorney, Agent, or Firm* — George David Zalepa; Greenberg Traurig, LLP

(57) ABSTRACT

A carrying case designed to transport tablescape items in smaller sub-containers nested within is disclosed. The carrying case includes a hardshell case, that includes a lid and base. The hardshell case is constructed of a rigid exterior and a padded interior. The carrying case additionally includes configured to be inserted into a cavity in the base. When inserted, the modular containers occupy substantially all of the available space in the cavity.

19 Claims, 20 Drawing Sheets

(56) References Cited

U.S. PATENT DOCUMENTS 2,998,129 A * 8/1961 Bekins ..... B65D 25/04 206/523
3,432,025 A * 3/1969 Luhe ..... A45C 11/20 206/545
3,497,057 A * 2/1970 Traner ..... B65D 77/003 206/730
4,093,010 A * 6/1978 Hunley ..... A45C 11/38 206/316.2
4,294,349 A * 10/1981 Ibsen ..... A61C 19/005 206/523
4,550,813 A * 11/1985 Browning ..... A45C 5/14 190/102
4,609,084 A * 9/1986 Thomas ..... A45C 9/00 190/110
5,806,944 A * 9/1998 Greenfield ..... A47B 81/04 190/12 R
6,059,179 A * 5/2000 Giampapa ..... A45C 7/0095 206/457
6,102,569 A * 8/2000 Wang ..... A45C 7/0022 220/9.2
2005/0145458 A1* 7/2005 Cohen ..... A45C 5/146 190/18 A
2005/0224305 A1* 10/2005 Davis ..... A45C 13/26 190/113
2006/0124503 A1* 6/2006 Groberg ..... A45F 3/46 206/541
2006/0169690 A1* 8/2006 Rothschild ..... A45C 7/0036 220/7
2008/0083592 A1* 4/2008 Mangano ..... A45C 7/0077 190/110
2009/0008202 A1* 1/2009 Dayton ..... G09F 3/08 190/100
2009/0321503 A1* 12/2009 Barnes ..... A45C 7/0095 229/103
2010/0230307 A1* 9/2010 Kriesel ..... G10G 7/005 206/314
2011/0272232 A1* 11/2011 Sheikh ..... A45C 5/03 190/111
2014/0299505 A1* 10/2014 Stahle ..... A45C 11/00 206/546
2015/0296945 A1* 10/2015 Douglas ..... A45C 11/20 220/592.2
2018/0141739 A1* 5/2018 Hengen ..... A45C 5/14
2019/0144164 A1* 5/2019 Breyburg ..... B65D 43/22 220/495.01

* cited by examiner

MODULAR TABLESCAPE CARRYING CASE

BACKGROUND

Technical Field

The disclosed embodiments related to carrying cases. In particular, the disclosed embodiments relate to a modular earning case for separating and transporting components of a tablescape.

Description of the Related Art

Currently, various techniques exist for transporting fragile items long distances. Generally, these techniques focus on hulk, commercial shipping, or shipping of individual items. For example, manufacturers package din netware in corrugated cardboard containers, sealed with shrink wrap, packaged in a bulk container, and shipped via commercial transport.

While such techniques have existed for some time, new services provide entire tablescapes to rent for events such as dinner parties. Such services provide all cutlery, dinner ware, glassware, as well as linens, and other sundry items in a single package. End-users use tablescape items for events having a scheduled date. Shippers of rental tablescapes generally attempt, to minimize the amount of time that tablescapes are in use. These factors result in shippers transporting tablescapes "just in time" for an event. Since the time between shipping and use is short, shippers require that tablescapes not be damaged during transit. However, existing packaging fails to meet this requirement.

In general, some services utilize cardboard packaging for shipping tablescapes. Cardboard packaging is generally not suitable for long-haul transport as the risks of damage are too significant. Further, the lifetime of a cardboard package is limited, thus contributing to significant environmental waste. Existing commercial shipping techniques generally utilize packaging that is not aesthetically pleasing and, similarly, includes significant waste (e.g., plastic shrink wrap, non-recyclable components, and excess cardboard).

Additionally, even if cardboard packaging may be used for return shipping, there are numerous deficiencies in using such packaging. First, the use of cardboard generally requires complicated packing systems. These systems are not amenable for re-use since the packaging cannot, easily be re-packed by hand by end-users. Second, cardboard packaging, even if used for return shipping, cannot generally be re-used for different end-users. Thus, cardboard packaging is limited to a single distribution and, in some cases, return. Third, most existing services rely on "generic" packaging. For example, a single large cardboard box may be segmented into a plurality of "areas" (e.g., cubes) for storing items. This configuration results in standardized total container size, but the packaging therein varies depending on the items, shipped, thus resulting in confusing and inconsistent internal packaging.

BRIEF SUMMARY

The disclosed embodiments solve these and other problems in the art, as described in more detail herein.

The disclosed embodiments provide, a carrying case designed to transport tablescape items in smaller sub containers nested within the carrying case. The sub-containers are designed and arranged to minimize air gaps within the carrying case when inserted into the carrying case. The carrying case includes a foam-lined hardshell case to protect the sub containers during transport. Each sub-container is explicitly designed for the items being transported. In one embodiment, the sub containers include a dinner plate bag, salad plate bag, drinkware bag, décor bag, and silverware roll bag.

In one embodiment a device is disclosed comprising a hardshell case, the hardshell case comprising a lid and base, the hardshell case including a rigid exterior and a padded interior; and a plurality of modular containers, the plurality of modular containers configured to be inserted into a cavity in the base, wherein when inserted the plurality of modular containers occupy substantially all of the available space in the cavity.

According to one embodiment, the rigid exterior is formed from a material suitable for commercial shipping. According to one embodiment, the rigid exterior comprises acrylonitrile butadiene styrene. According to one embodiment, the padded interior comprises foam padding. According to one embodiment, the foam padding comprises 1-inch foam padding in the base and ½-inch foam padding in the lid. According to one embodiment, the device further comprises two handles on opposite sides of the hardshell case. According to one embodiment, the lid includes a cavity formed via a lid flap present on the interior side of the lid, the lid flap connected to the lid via a zipper. According to one embodiment, the lid flap further includes one or more pockets.

According to one embodiment, the plurality of modular containers includes a drinkware bag, a décor bag, a dinner plate bag, a salad plate bag, and a silverware roll bag. According to one embodiment, the décor bag is inserted on the bottom of the cavity and against a first sidewall of the cavity, the décor bag having a depth substantially equal to the depth of the cavity. According to one embodiment, the drinkware bag is inserted atop the décor bag, the drinkware bag and against the first sidewall of the cavity, the drinkware bag having a depth substantially equal to the depth of the cavity. According to one embodiment, the dinnerplate bag is inserted on the bottom of the cavity and against a second sidewall of the cavity, the second sidewall opposite the first sidewall the dinner plate bag having a depth substantially equal to the depth of the cavity. According to one embodiment, the salad plate bag is inserted between the dinner plate bag and the décor bag and drinkware bag. According to one embodiment, the silverware roll bag is inserted between the dinner plate bag and décor bag and adjacent to the salad plate bag. In one embodiment, the device further comprises an auxiliary bag, the auxiliary bag inserted between the dinner plate bag and salad plate bag.

According to one embodiment, drinkware bag includes an internal divider, the internal divider removable from the drinkware bag. According to one embodiment, the drinkware bag, décor bag, dinner plate bag, and salad plate bag each include at least one zipper. According to one embodiment, the drinkware bag, décor bag, dinner plate bag, salad plate bag, and silverware roll bag each include padding, the padding comprising a material selected such the padding is thinner than padding preset in the padded interior. According to one embodiment, the device further comprises a zipper connecting the lid and base. According to one embodiment, the lid further comprises a debossed area on the exterior facing side of the lid, the debossed area sized to house a shipping label.

BRIEF DESCRIPTION OF THE DRAWINGS

The preceding and other objects, features, and advantages of the disclosure will be apparent from the following description of embodiments, as illustrated in the accompanying drawings, in which reference characters refer to the same parts throughout the various views. The drawings are not necessarily to scale, emphasis instead being placed upon illustrating principles of the disclosure.

DETAILED DESCRIPTION

Figure 1:
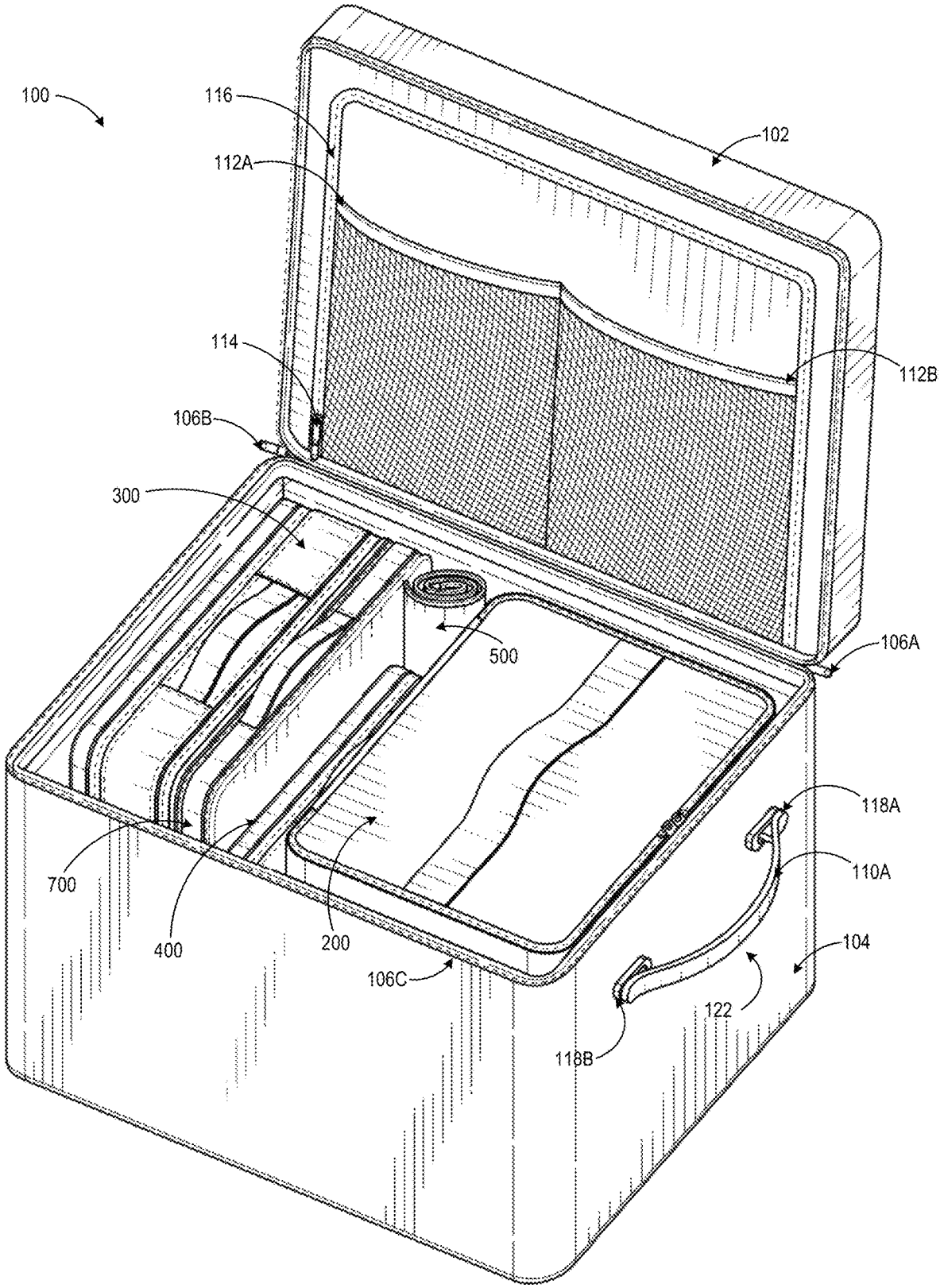
FIG. 1 is a perspective view of a modular carrying case in an opened state according to some embodiments of the disclosure.

FIGS. 1 through 10 provide various views of a modular carrying case according to some embodiments of the disclosure. Identification of the specific views of FIGS. 1 through 10 are provided in the Brief Description of the Drawings above and are not repeated herein. The numbering of reference numerals in FIGS. 1 through 10 is consistent, and descriptions of each element are not repeated for each Figure.

Figure 2:
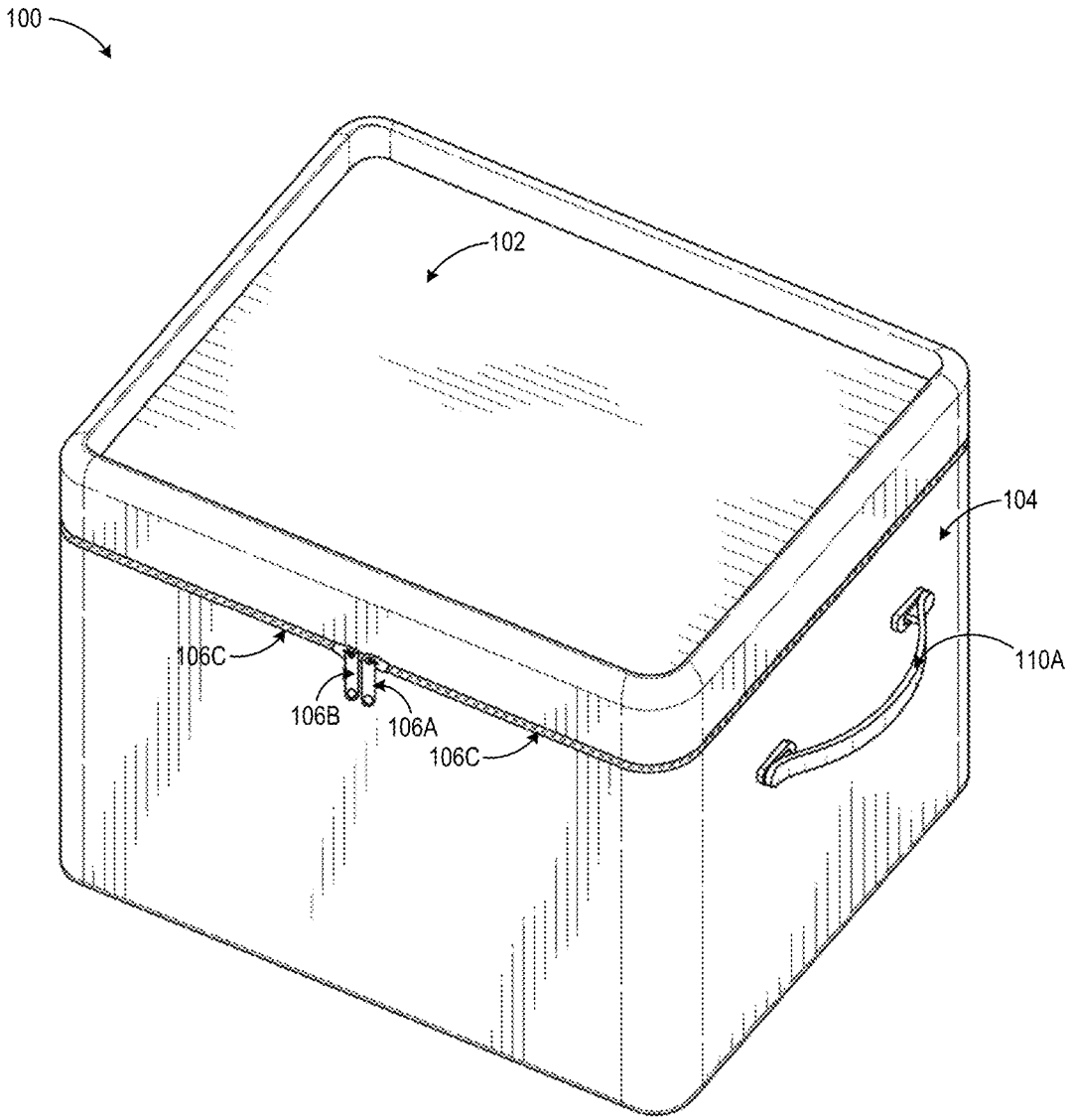
FIG. 2 is a perspective view of a modular carrying case in a closed state according to some embodiments of the disclosure.
Figure 3:
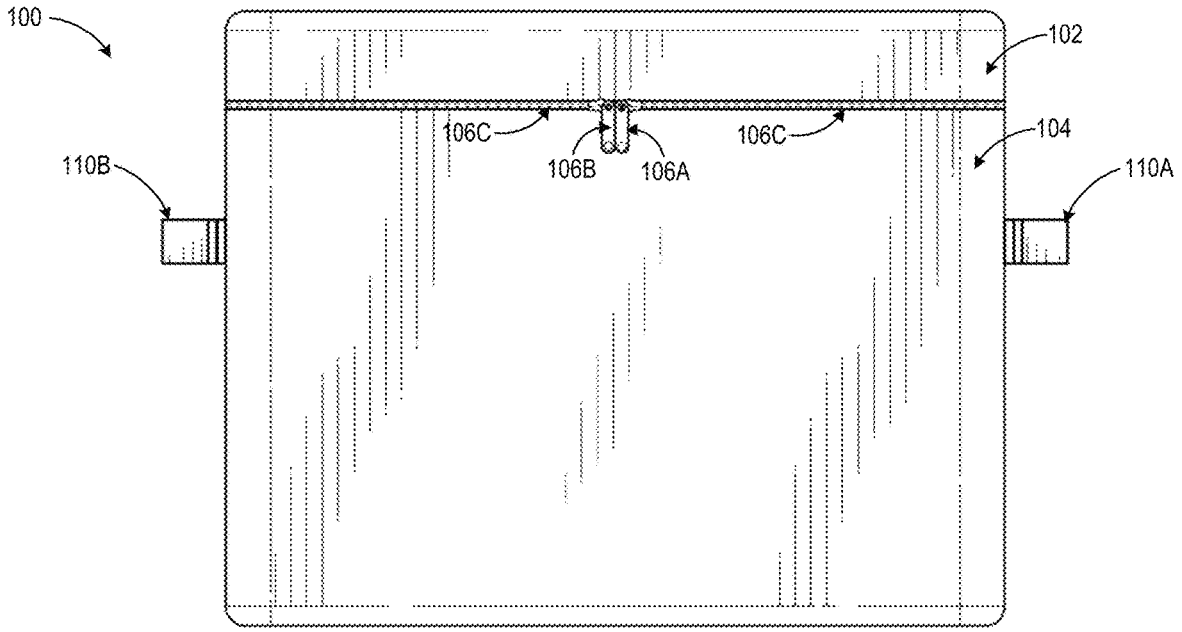
FIG. 3 is a front elevation view of a modular carrying case according to some embodiments of the disclosure.

In the illustrated embodiment, a carrying case (100) includes a lid (102) and a base (104). As illustrated in FIGS. 1 and 2, the lid (102) is pivotable about an axis to open (FIG. 1) and close (FIG. 2) thus allowing for or preventing access to the contents (200, 300, 400, 500, 600, 700) therein. In the illustrated embodiment, the lid (102) connects to the base (104) via a zipper. As used herein, zipper pulls (106*a*, 106*b*) and zipper track (106*c* illustrated in, for example, FIG. 2) are referred to as a zipper. In the illustrated embodiment, the track (106*c*) of the zipper is partially located on the lower, outer edge of the lid (102) and partially located on the upper, outer edge of the base (104). Two zipper pulls (106*a*, 106*b*) are situated on the track (106*c*) and, when closed, seal the case (100). In one embodiment, a locking mechanism may be used to lock the sapper. For example, each zipper pull (100*a*, 100*b*) may comprise a substantially rectangular (or rounded rectangular) metal structure, the metal component having a hole at one end, distal to the track. The locking mechanism may be inserted through each of the holes and locked when joining both zipper pulls (106*a*, 106*b*). In some embodiments, the locking mechanism may comprise a lock, such as a key or code-activated lock. In some embodiments, the zipper may comprise large- or heavyweight zippers (e.g., #8, #9, #10, or larger zipper weights). For example, in some embodiments, the zipper may comprise a #8 zipper (i.e., two #8 zipper pulls and a #8 zipper track). In some embodiments, the zipper comprises a nylon zipper, although other materials such as metal, molded plastic, or coil. In the illustrated embodiment, a closed bottom zipper is used, while at other embodiments, a separating zipper may be used.

In the illustrated embodiment, the lid (102) includes slip pockets (112*a*, 112*b*). In the illustrated embodiment, the slip pockets (112*a*, 112*b*) comprise mesh panels attached to the surface of the lid flap (116). In the illustrated embodiment, two slip pockets (112*a*, 112*b*) are used; however more, or fewer slip pockets may be used as needed. In the illustrated embodiment, each slip pocket is formed to create an opening on one (out of four) sides. In the illustrated embodiment, the slip pockets (112*a*, 112*b*) may be used to store flat items. For example, in some embodiments, menus, papers, instructions, return labels, or other flat items may be stored in the slip pockets (112*a*, 112*b*) during shipping. Although illustrated as mesh, the slip pockets (112*a*, 112*b*) may comprise a solid material such as polyester or similar materials. In another embodiment, the slip pockets (112*a*, 112*b*) may be sealable. In these embodiments, the open side of the slip pockets (112*a*, 112*b*) may be equipped with a zipper, Velcro, or similar sealing mechanism. In some embodiments, the slip pockets (112*a*, 112*b*) may compose a transparent or translucent material allowing for viewing of materials when stored therein.

In the illustrated embodiment, the ltd (102) is hollow. In the illustrated embodiment, a zipper (114) extends around three sides of the rectangular lid (102). In one embodiment, the zipper (114) may comprise a single zipper pull. In other embodiments, such as that illustrated, two zipper pulls may be used. The specific length or percentage of the perimeter the zipper (114) extends is trot limiting. In the illustrated embodiment, the zipper (114) may be opened to expose the hollow cavity of the lid (102). In one embodiment, the zipper (114) comprises a medium weight zipper. For example, in some embodiments, the zipper comprises a #5 nylon zipper. In other embodiments, a #6 or #7 zipper may be used. Alternatively, or in conjunction with the foregoing, metal, coil, or molded plastic zippers may be used.

Figure 9:
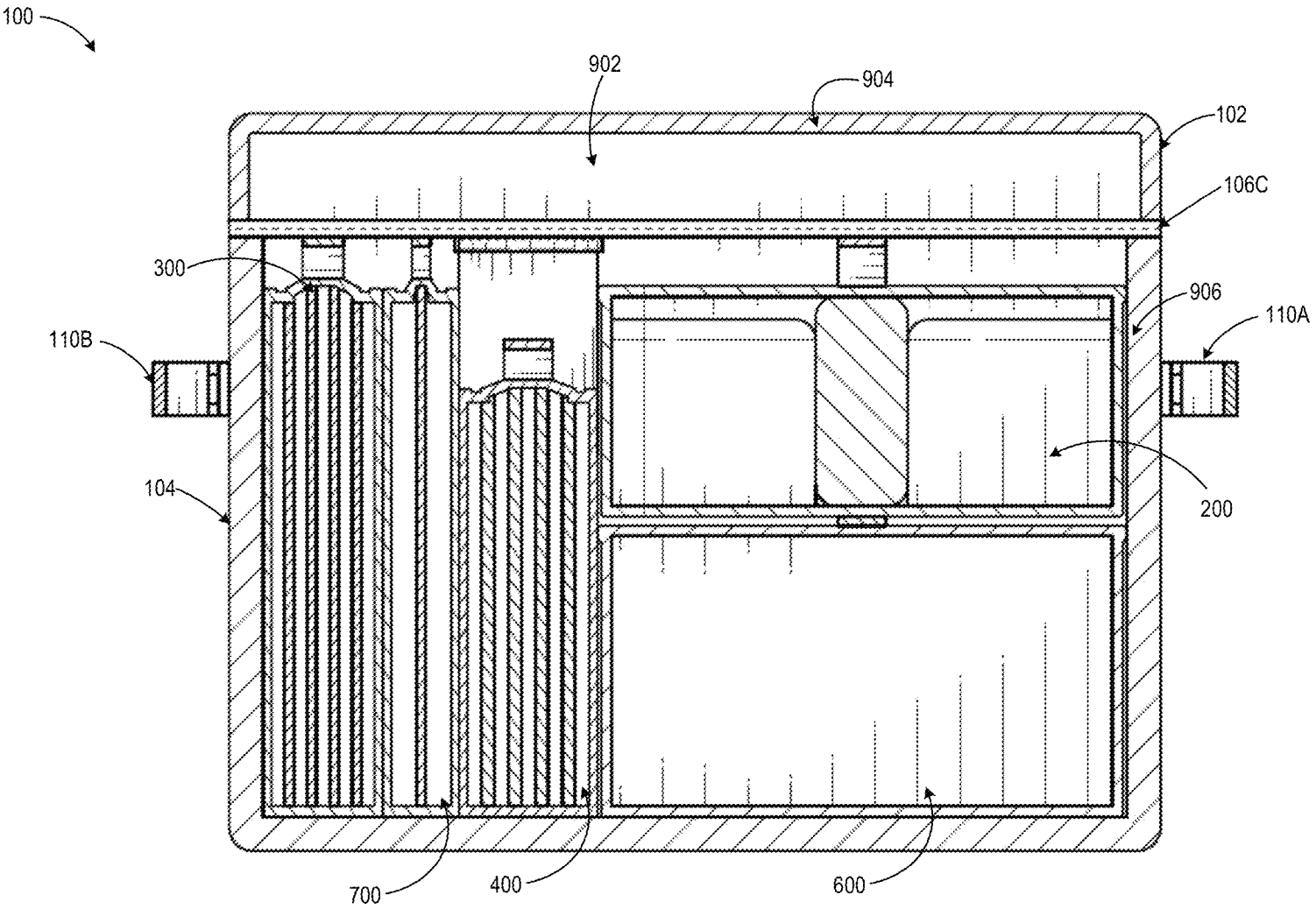
FIG. 9 is a section view of a modular carrying case according to some embodiments of the disclosure.

An example of such a cavity is illustrated in the cross-section view of the case (100) depicted in FIG. 9. As illustrated in that FIG. 9, the cavity (902) spans the entire length and width of the lid (102). In the illustrated embodiment, the cavity (902) in the lid (102) may be used to store flat items such as linens, napkins, placemats, or soft goods. In other embodiments, the cavity (902) may be segmented in various manners to provide modular storage for smaller items.

In the embodiment illustrated in FIG. 9 and other figures, the lid (102) includes a padding layer (904), referred to as a "lid padding layer" when needed to distinguish from the padding layer (906). In one embodiment, the padding layer (904) is situated on all external-feeing surfaces of the lid (102). That is, the padding layer (904) is present on the top, left, right, front, and rear surfaces of the lid (102). As illustrated, no padding may be present on the rear surface of the lid, i.e., the surface contacting with the base (104). In the illustrated embodiment, the padding layer (904) may comprise a high-density foam padding. In this embodiment, the padding layer (904) provides an insulating effect due to the high density of the foam. In one embodiment, the padding layer (904) comprises a one-half inch padding.

In the illustrated embodiment, the height, of the entire, lid (102) is 2.5", including the one-half inch padding on the top of the lid (102). As will be described, the entire case (100) may have dimensions of 18"(width), 16"(height), and 14" (depth). Thus, the ltd may have dimensions of 18" (width), 2.5" (height), and 14" (depth). Unless otherwise noted, ail dimensions are end-to-end and include any padding. Specific dimensions are not intended to be limiting and are only provider as examples.

Turning to FIG. 2, the lid (102) may include additional, optional features not illustrated in the specific illustrated embodiment. In some embodiments, the lid (102) may include a debossed section for stoning label information. In some embodiments, the size of this debossed section is configured based on the dimensions of shipping label sizes. For example, standard UPS®, FedEx®, or USPS® shipping label dimensions may be used to size the debossed section. In some embodiments, this debossed section is covered with transparent or translucent covering, in some, embodiments, the debossed section is sealable and, in some embodiments, re-sealable to allow for the insertion and removal of shipping labels both by shippers and customers. Thus, this section enables a consistent location for return labeling and ensures that labels are not damaged during shipping. Alternatively, or in conjunction with the foregoing, the lid (102) may include another debossed portion that comprises a debossed graphical logo or wordmark for identification. In some embodiments, the faces of the base (104) may also include a debossed graphical logo or wordmark. In some embodiments, the lid (102) may comprise a planar lid while in other embodiments, such as that illustrated, the lid (102) may include a debossed main body and beveled edge.

Figure 4:
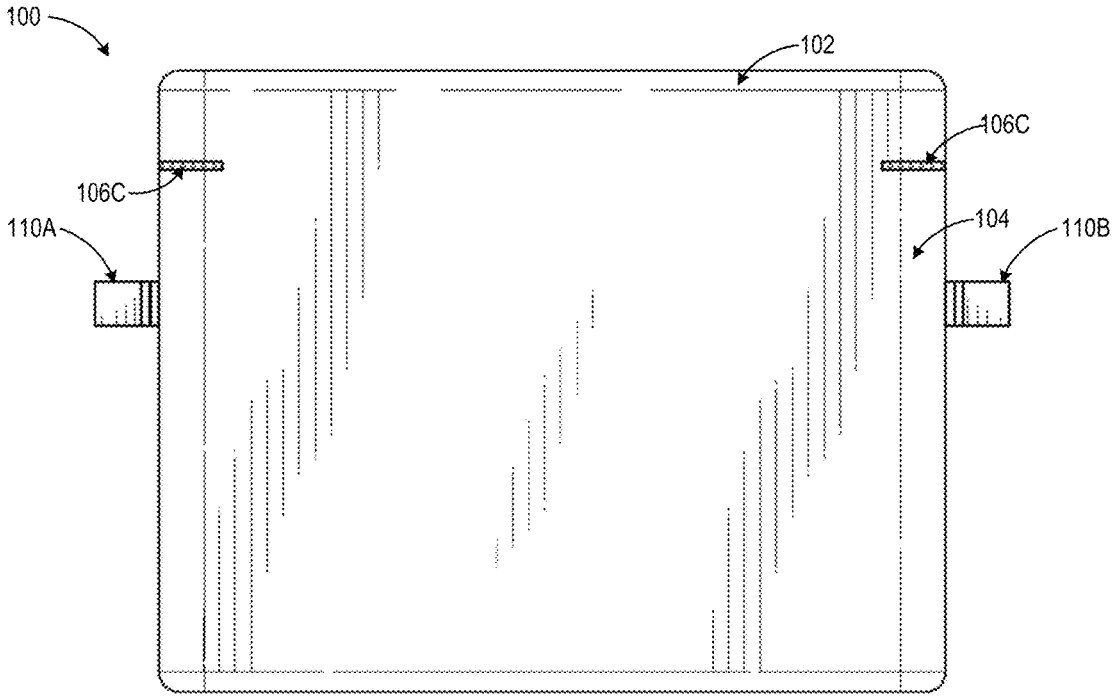
FIG. 4 is a rear elevation view of a modular earning case according to some embodiments of the disclosure.
Figure 5:
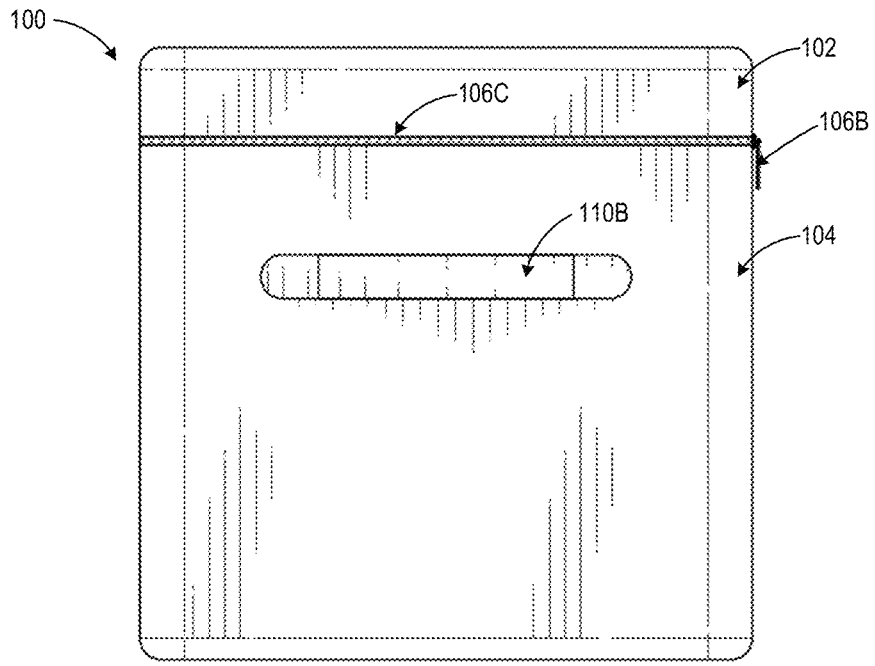
FIG. 5 is a left elevation view of a modular carrying case according to some embodiments of the disclosure.
Figure 6:
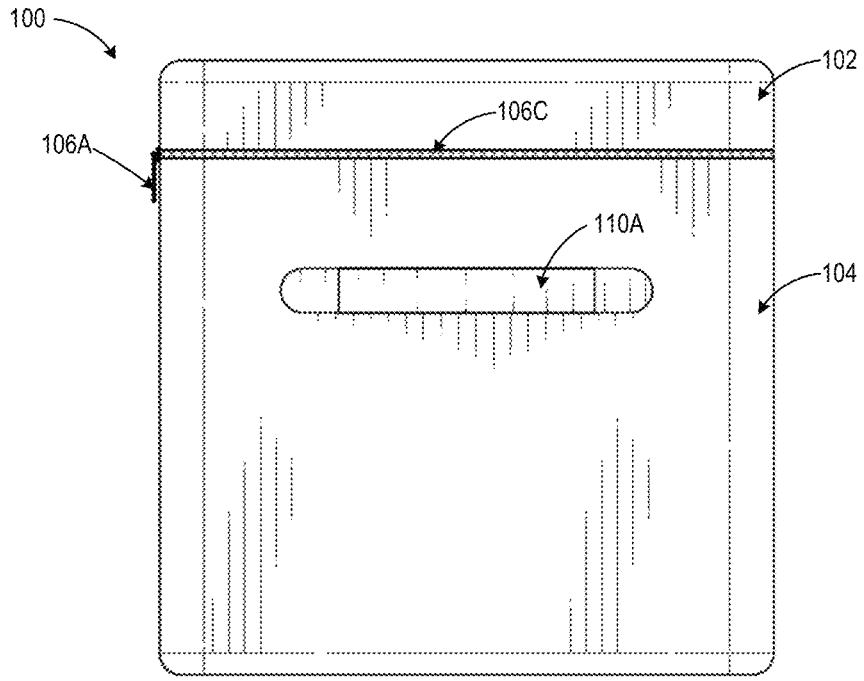
FIG. 6 is a right elevation view of a modular carrying case according to some embodiments of the disclosure.
Figure 7:
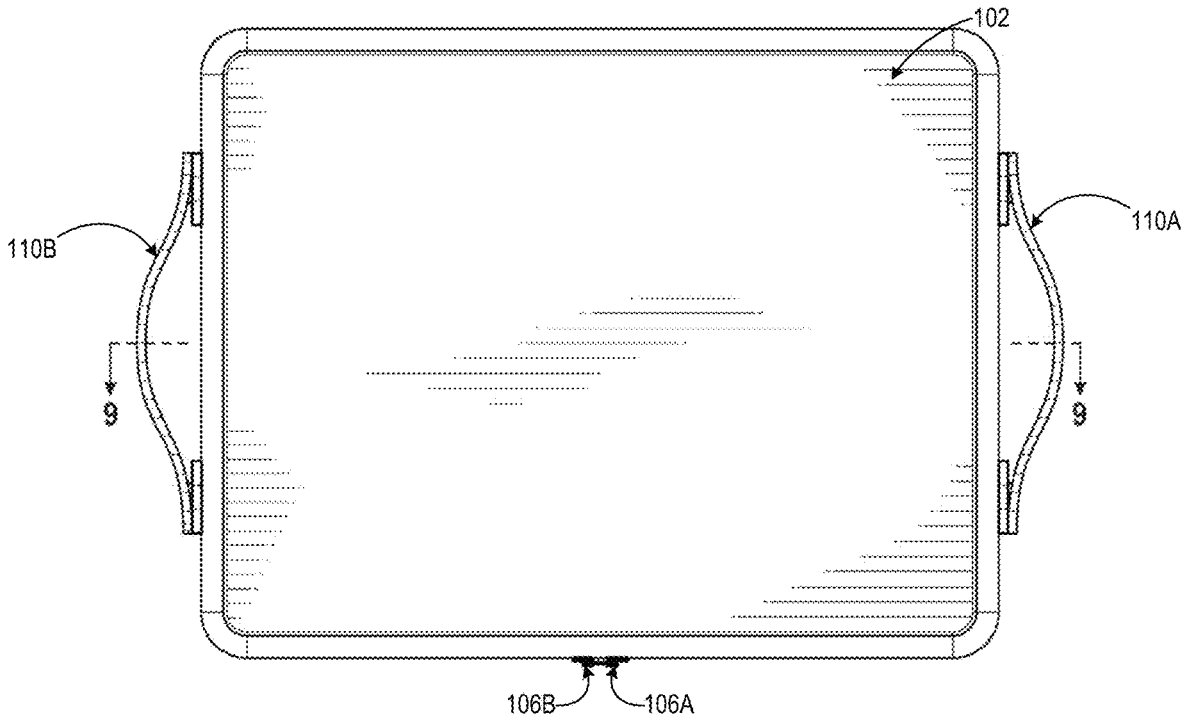
FIG. 7 is a top plan view of a modular carrying case according to some embodiments of the disclosure.
Figure 8:
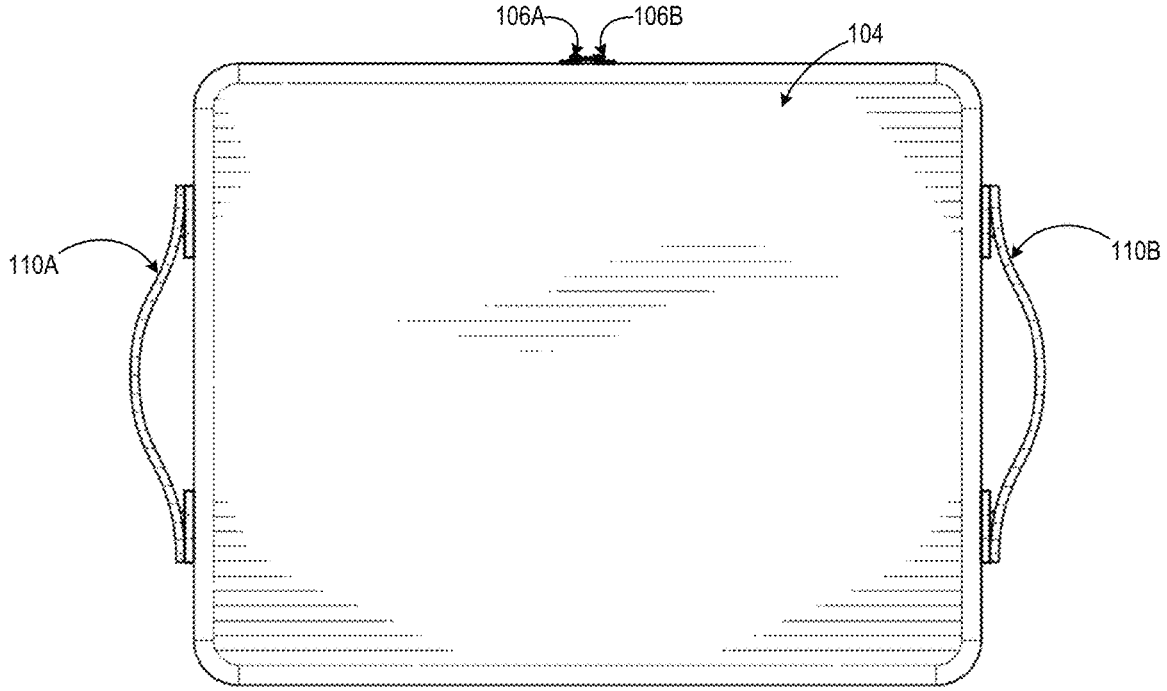
FIG. 8 is a bottom plan view of a modular carrying case according to some embodiments of the disclosure.

Turning to FIG. 4, in some embodiments, the lid (102) and base (104) are formed of a single fabric. That is, the portion between the ends of the zipper track is a single fabric. In some embodiments, this fabric comprises a heavyweight polyester material. For example, the material may comprise, an eight-ounce polyester canvas. Thus, as illustrated in FIG. 4, the lid (102) and base (104) are connected via a seamless hinge. In ocher embodiments, however, the materials of the ltd (102) and base (104) may be separate, forming a defined, hinge between the two.

Returning to FIG. 1, the case (100) includes a base (104) that stores a plurality of sub-containers (200, 300, 400, 300, 600, 700). Sub-containers (200, 300, 400, 500, 700) and other internal sub-containers (600) are described in mote detail herein, and are not discussed in detail with respect to FIG. 1. In some embodiments, sub-container (700) is optional and the case (100) only includes sub-container (200, 300, 400, 500, and 600).

As illustrated in FIG. 1, the base (104) comprises a cuboid. As illustrated in RIGS. 9 and 10, the base (104) comprises a hollow cuboid when sub-containers (200, 300, 400, 500, 600, 700) are not placed therein. In the illustrated embodiment of FIG. 9, the base container includes a padding layer (906), referred to as a "base padding layer" when needed to distinguish from the padding layer (904). In the illustrated embodiment, the padding layer (906) comprises a high-density foam padding layer similar to, or identical to, padding layer (904). However, in the illustrated embodiment, the padding layer (906) comprises a one-inch layer of padding (versus a one-half inch padding layer). In some embodiments, the base (104) has dimensions of 18" (width), 12.5" (height), and 14" (depth), in some embodiments, the internal cavity has corresponding dimensions of 16"×12.5"×12". In some embodiments, zipper may comprise a one-inch area of the total height. As with the dimensions of the ltd, the specific dimensions are not intended to limit the disclosed embodiments.

In the illustrated embodiments, the base (104) includes two handles (110*a*, 110*b*; on the left and right feces. As illustrated in FIG. 1, a given handle (110*a*) includes two anchor portions (118*a*, 118*b*) and a strap portion (122). In the illustrated embodiment, each portion of the handles (110*a*) (i.e., attachment member, anchors, and strap) comprise a hard plastic. In the illustrated embodiment, the handles (110*a*, 100*b*) are in an extended mate. In one embodiment, the extended state is actuated by an outward force on the strap portion (122) and away from base (104). In one embodiment, this outward force is caused by a human hand. When not extended, strap portion (122) is configured to rest flat on the surface of base portion (104).

In some embodiments, the base (104) and lid (102) both comprise an internal hardshell. In some embodiments, this hardshell hues the entire case (100). In one embodiment, the hardshell is made of an acrylonitrile butadiene styrene (ABS) material. In these embodiments, the padding (904, 906) is adhered to the hardshell case. The hardshell with adhered padding (904, 906) is then covered with fabric material (e.g., polyester, or polyester canvas) to provide a more pleasing experience. In some embodiments, the polyester coatings are adhered to the hardshell case (i.e., opposite the padding). In some embodiments, polyester canvas is used to cover the exterior side of the hardshell case. Similarly, a lighter weight polyester fabric (e.g., non canvas) may be used to line the inferior surfaces (and padding) of the hardshell case. In some embodiments, the combination of a hardshell case and thick, high density; foam padding provides significant protection of the internal contents during shipping and thus allows for lighter weight internal storage sub-containers, as will be described in more.

Turning to FIG. 9, the sizing of the case (100) may be based on the internal sub-containers. As illustrated, the base (104) is configured such that each of the internal sub-containers fits within the base (104) while excess space is minimized. For example, the heights of sub containers (200, 600) are selected such that the total height is equal to the height of the base (104). Further, the heights of sub-containers (400, 500) are equally chosen to have a total height equal to the height of the base (104). Further, the widths of sub containers (300, 400, 500) are selected such that the total width of will sub-containers is equal to the width of the base (104). Those of skill in the art will recognize that the specific configuration in FIG. 9 is not limited, and other configurations and sizings may be used provided that the space inside the base (104) is maximized. As one example, a sub container (500) may be positioned atop sub-container (400) while retaining maximum space usage. Similarly, sub-containers (200, 600) may be swapped while retaining maximum space usage. In other embodiments, the dimensions of the individual sub-containers (200, 300, 400, 500, 600, 700) may be adjusted as needed.

By maximizing space usage based on the sizing of sub containers (200, 300, 400, 500, 600, 700), multiple goals are achieved. First, the closeness of the sub-containers (200, 300, 400, 500, 600, 700) minimizes damages due to weight shifting and impacts. Second, the specific arrangement reduces the risk of mispackaging when customers return the items, resulting in levs damage. Third, in combination with a hardshell case and foam paddings the sub-containers (200, 300, 400, 500, 600, 700) are not required to be individually protected as much as existing designs. Thus, more of the internal space of the base (104) may be used, and complicated packaging designs of internal sub containers (200, 300, 400, 500, 600, 700) are avoided. Details of the sub-containers (200, 300, 400, 500, 600, 700) are described in more detail herein.

In some embodiments, the case (100) may further include a plurality of corner guard portions on some of all of the four corners on lid (102) and four corners of base (104). Thus, in some embodiments, the case (100) may include eight corner guards. In some embodiments, the corner guard comprise raised plastic (or similarly suited material) portions extending horn the corners of the lid (102) and base (104). As one example, the corner guards may extend along the depth and width of a given corner fora predetermined distance (e.g., two inches). The corner guard may correspondingly extend on the top side (in the case of lid, 102) or bottom side (in the case of base, 104) of the case (100), thus forming a three-sided guard. In some embodiments, the distance the corner guard extends over the top or bottom side of the case (100) may be equal to or similar to the distance the corner guard, extends along the depth and width of the case (100). Further, the corner guards may extend along (e.g., downward in the case of lid, 102, and upward in the case of base, 104) the height of the case for a similar distance. The specific dimensions, thickness, and material of the corner guard are not intended to be limiting. In some embodiments, the corner guards are used to further protect the case (100) during shipping, preventing large blunt forces directly to the walls, lid (102), and base (104) of the case.

FIGS. 11 through 19 provide various views of a drinkware bag according to some embodiments of the disclosure, identification of the specific views of FIGS. 11 through 19 are provided in the Brief Description of the Drawings above and are not repeated herein. The numbering of reference numerals in FIGS. 11 through 19 is consistent, and descriptions of each element are not repeated for each Figure.

In the illustrated embodiment, a drinkware bag (200), alternatively refereed to as a "sub-container," comprises a lid (202) connected to a base (204) via a dipper, the zipper comprising a track (206*c*) and a plurality of zipper pulls (206*a*, 206*b*). As used herein, zipper polls (206*a*, 206*b*) and zipper track (206*c*) are referred to as a zipper. The lid (202) and base (204) are formed as a single fabric container with hinge portions on the backside of the bag (200). In one embodiment, the bag (200) has dimensions of 9"×5.5"×11.5" (W×H×L), although the specific measurements are not intended to be limiting. As illustrated in FIGS. 13-18, the lid (202) may additionally include a handle (208) situated in the middle of the lid (202). As will be described, when stacked with the décor bag (600), the total height of the two bags (200, 600) is 11.5" (the internal height of the cavity of base 104). Additionally, a ¼ inch gap is provided on the front and rear sides of the stacked bags (200, 600) while the total width of the stacked bags (200, 600) is 9".

In the illustrated embodiment, the bag (200) is made of a main fabric. In some embodiments, the main fabric comprises an eight-ounce polyester canvas. As used herein, a main fabric refers to an exterior fabric that is used to form the structure of the bag (200). The main fabric is sewn to a lining fabric. In some embodiments, the lining comprises a polyester material. In one embodiment, the lining comprises a 150-polyester material. As will be discussed, the lining may comprise the inner lining of the lid (202) and the sidewalls and bottom of the base (204). In the illustrated embodiments, the material forming the internal divider (210) may comprise a different fabric. However, in some embodiments, the material forming the internal divider (210) may compose the same fabric as the lining.

In the illustrated embodiment, the main fabric and the lining are sewn together to form the exterior walls of the bag (200). In some embodiments, a foam layer is inserted between the main fabric and lining prior to sewing the layers together. In one embodiment, the foam layer comprises an expanded polyethylene (EPE) foam layer. In some embodiments, the foam layer is ten millimeters thick. In one embodiment, the handle (208) on the surface of the lid (202) comprises a one-inch polyester strap. In some embodiments, the polyester may comprise a spun polyester strap. In some embodiments, the spun polyester comprises a spun polyester webbing. In the illustrated embodiment; the strap (208) is sewn to the top of the lid (202) and includes slack to form a raised portion providing a handle. In the illustrated embodiment, the zipper comprises a medium weight zipper. For example, in some embodiments, the zipper comprises a #5 nylon zipper. In other embodiments, a #6 or #7 zipper may be used. Alternatively, or in conjunction with the foregoing, metal, coil, or molded plastic zippers may be used. In some optional embodiments, the bag (200) may additionally include ¾ inch piping along the edges of the sides.

Figure 10:
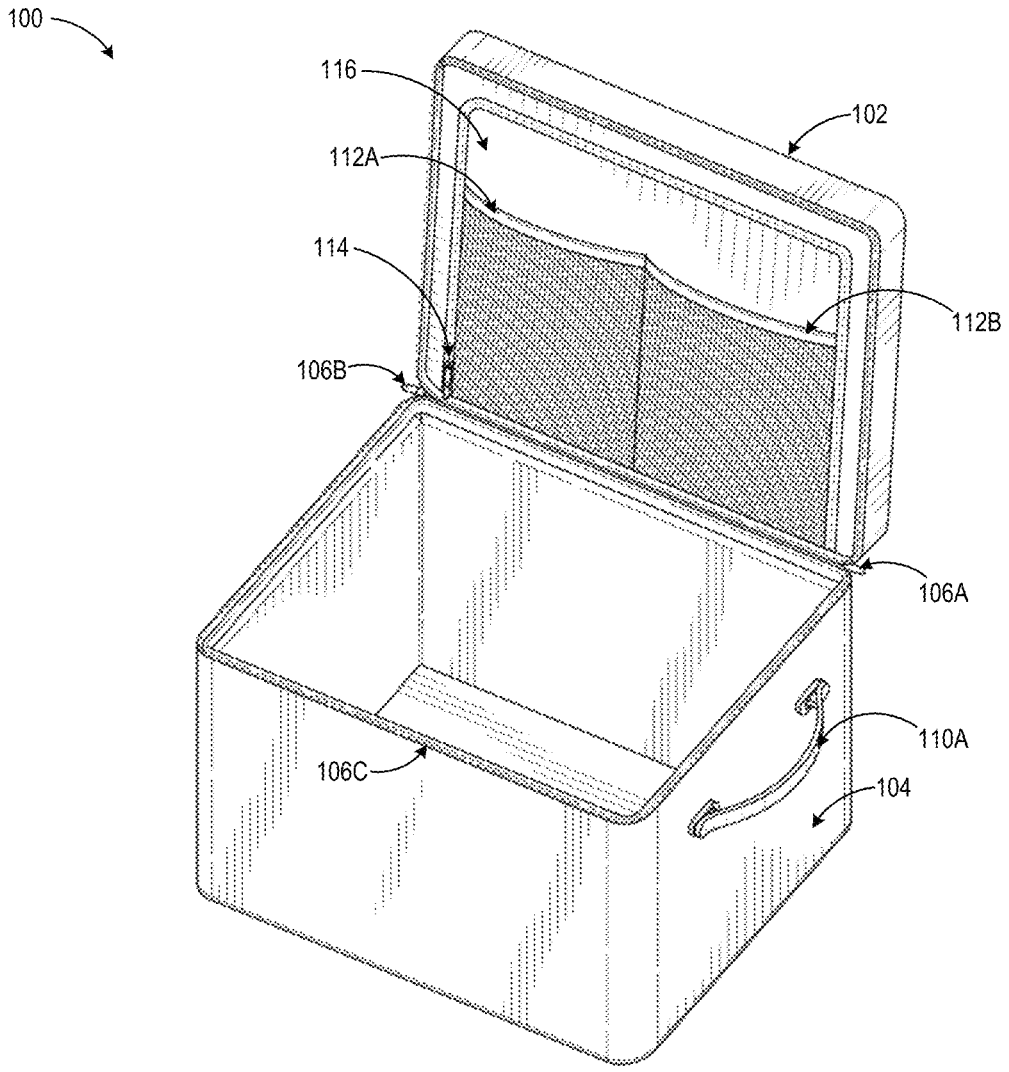
FIG. 10 is a perspective view of an emptied modular carrying case in an opened state with all sub-containers removed according to some embodiments of the disclosure.
Figure 11:
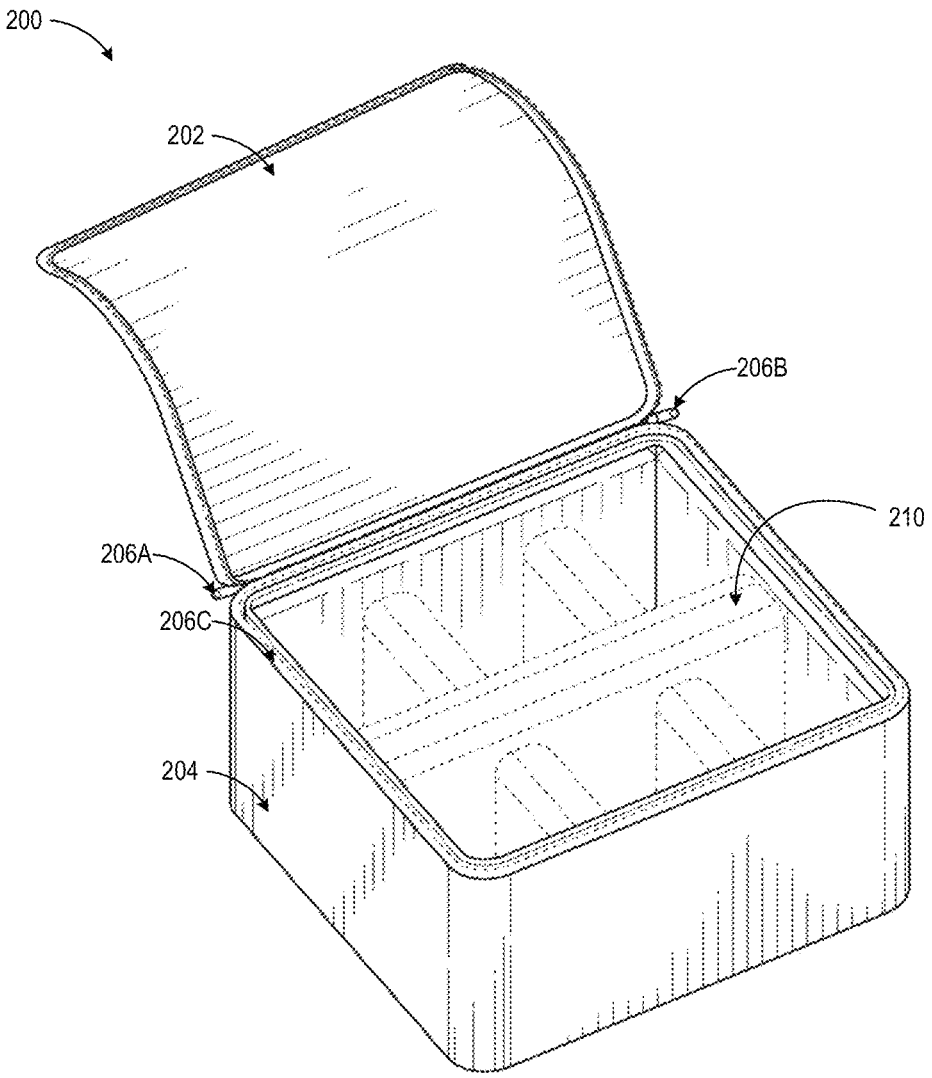
FIG. 11 is a perspective view of a drinkware bag in an opened state according to some embodiments of the disclosure.
Figure 12:
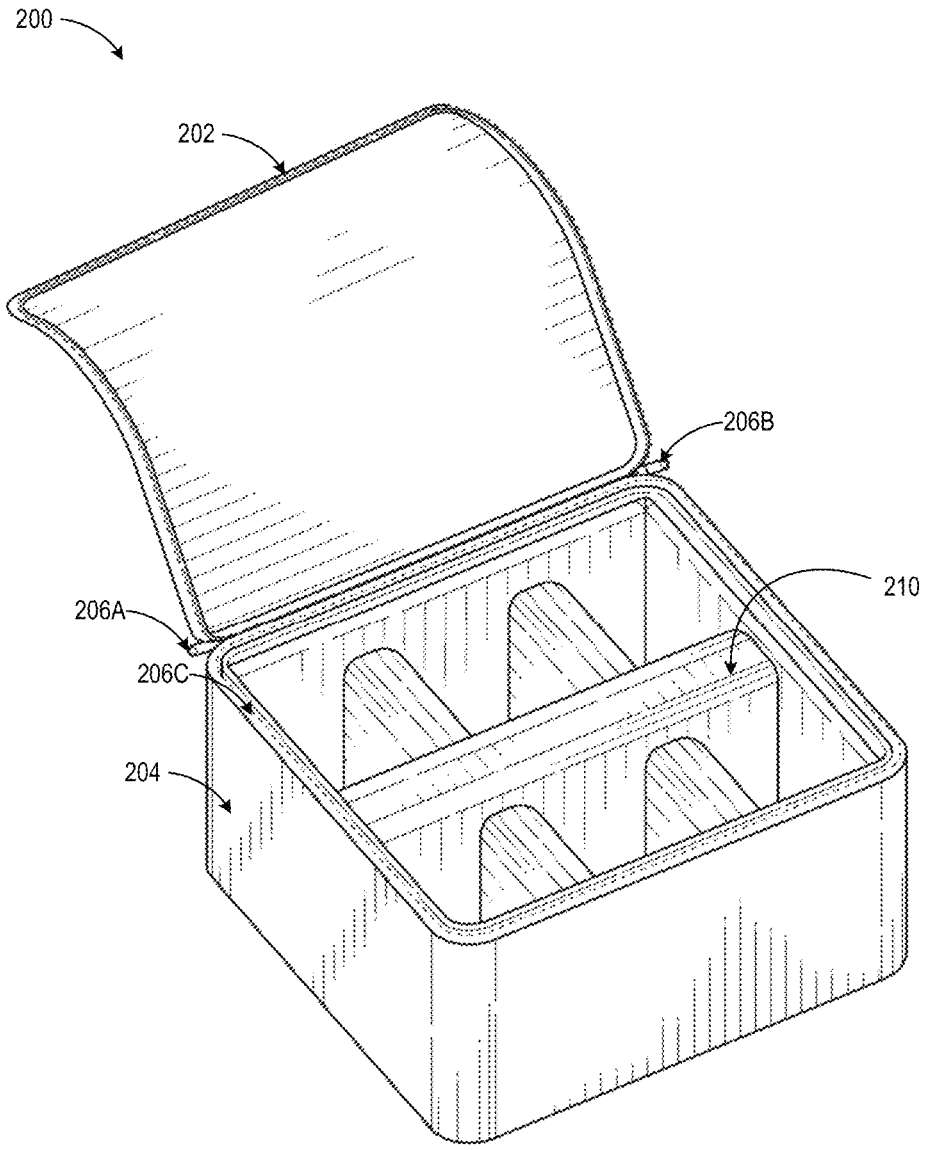
FIG. 12 is an alternative perspective view of a drinkware bag in an opened state according to some embodiments of the disclosure.
Figure 13:
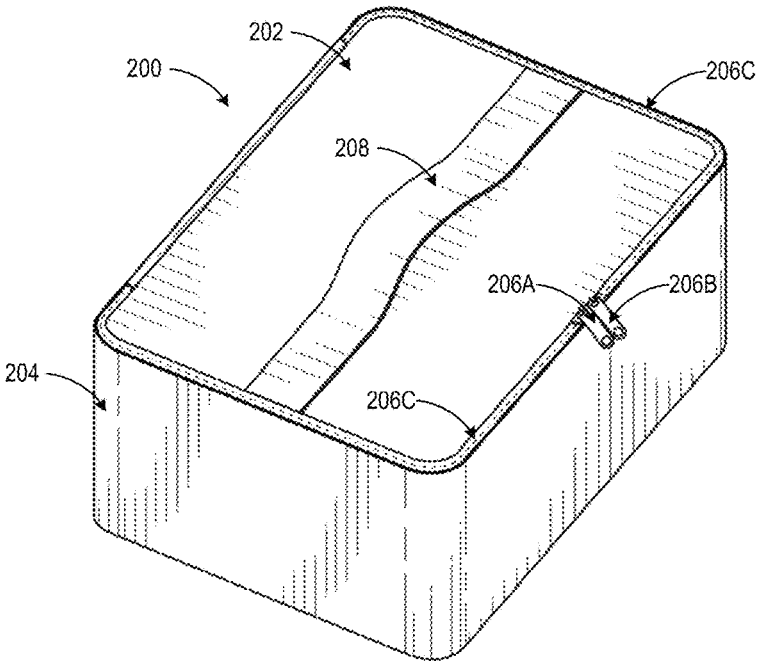
FIG. 13 is a perspective view of a drinkware bag in a closed state according to some embodiments of the disclosure.
Figure 14:
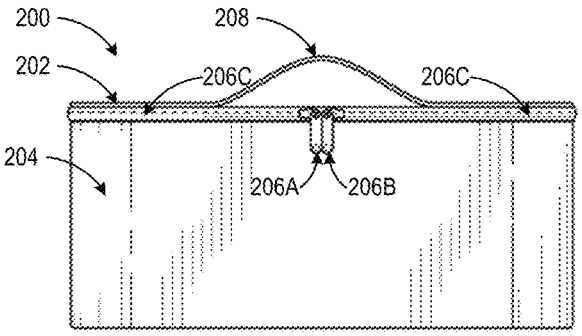
FIG. 14 is a front elevation view of a drinkware bag according to some embodiments of the disclosure.
Figure 16:
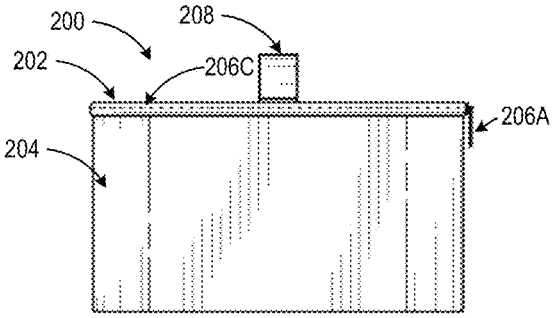
FIG. 16 is a left elevation view of a drinkware bag according to some embodiments of the disclosure.
Figure 15:
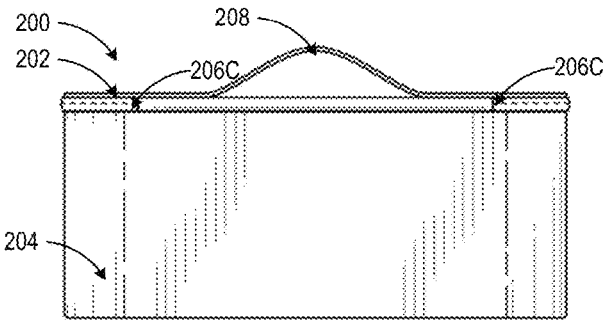
FIG. 15 is a rear elevation view of a drinkware bag according to some embodiments of the disclosure.
Figure 17:
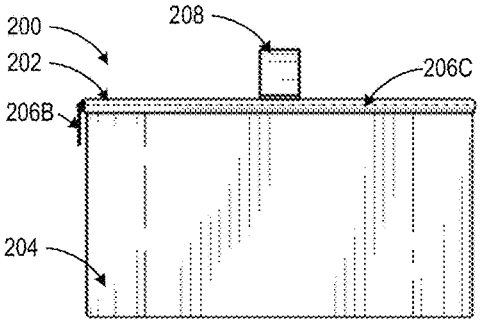
FIG. 17 is a right elevation view of a drinkware bag according to some embodiments of the disclosure.
Figure 18:
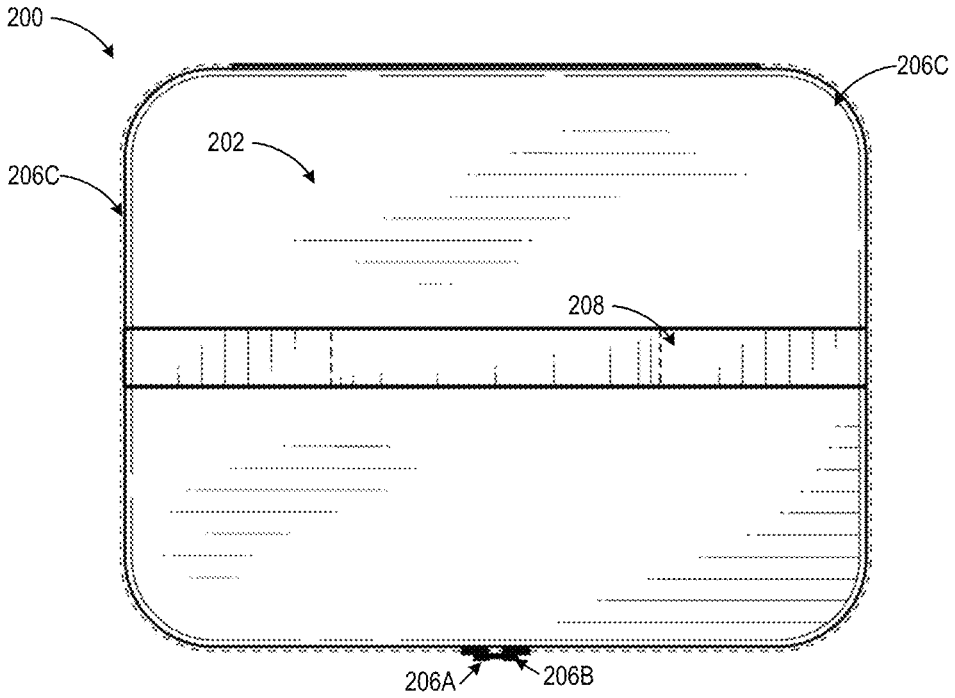
FIG. 18 is a top plan view of a drinkware bag according to some embodiments of the disclosure.
Figure 19:
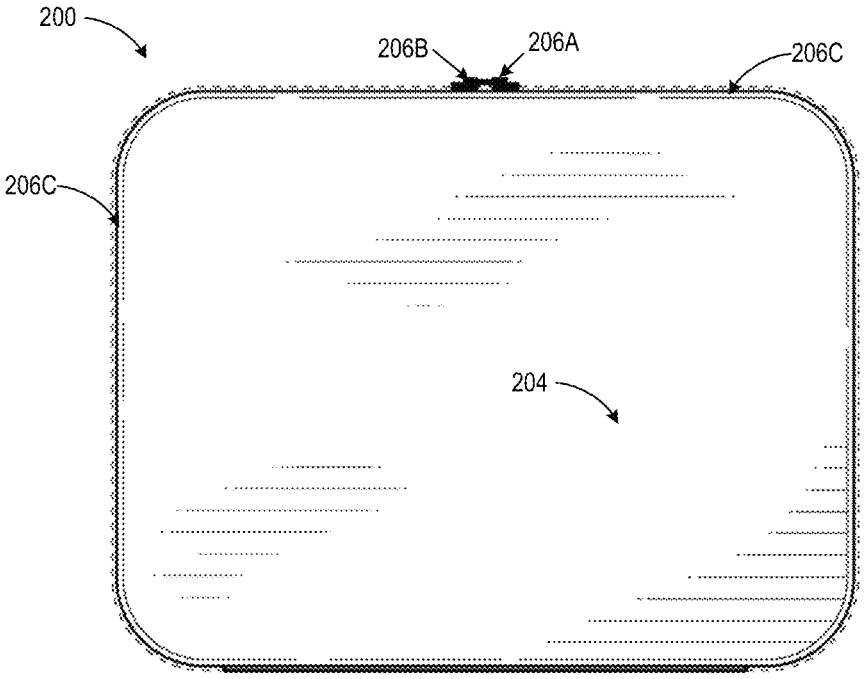
FIG. 19 is a bottom plan view of a drinkware bag according to some embodiments of the disclosure.
Figure 20:
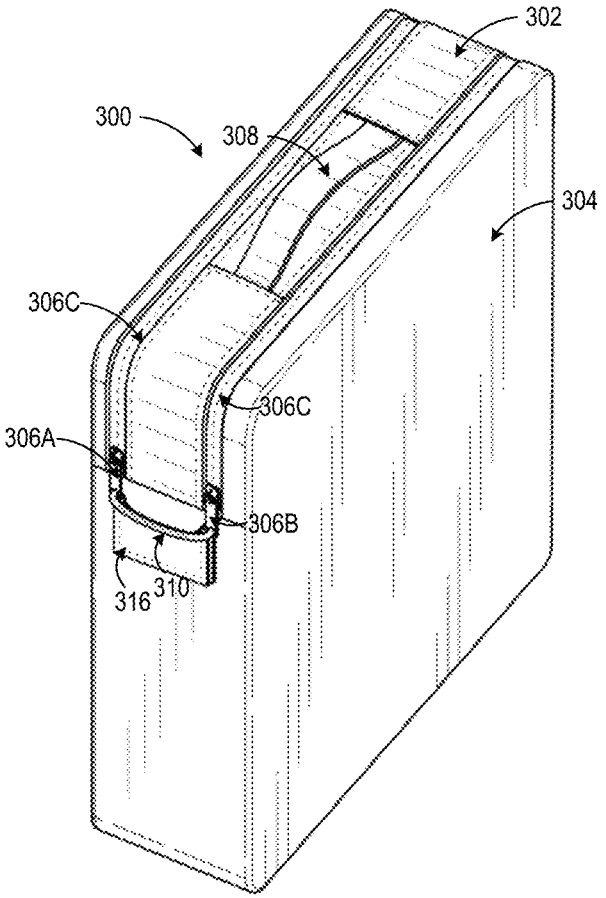
FIG. 20 is a perspective view of a dinner plate bag in an opened state according to some embodiments of the disclosure.

As illustrated its FIGS. 10 and 11, the bag (200) may include an internal divider (210). In some embodiments, the internal divider (210) is formed using a velvet material, in some embodiment's, the internal divider (210) is formed using a sponge material to form the vertical walls of the internal divider (210). In some embodiments, the sponge comprises a 33-millimeter sponge material. In FIG. 11, the internal divider (210) is illustrated as a structural component of the bag (200). That is, in one embodiment, the internal divider (210) may be sewn to the base (204) of the bag (200). In FIG. 10, however, the internal divider (210) is optional or removable. In this embodiment, the internal divider (210) can be removed as needed. In these embodiments, Velcro fasteners may be used to secure the internal divider (210) to the base (204). In these embodiments, Velcro may be placed on the sides and bottom of the base (204) and the corresponding faces of the internal divider (210). In some embodiments, 1-inch Velcro strips may be used.

In the illustrated embodiment, the internal divider (210) is designed to form six cavities. These six cavities can then be used to house six glasses or other drinkware. The specific number of cavities is not intended to be limiting. In some embodiments, different sized internal dividers may be used interchangeably let support different configurations of drinkware. For example, eight cavities may be used to support narrower glasses. In some embodiments, fever cavities may be used to support wider glassware, pottery, or other objects. By utilizing different sizes of dividers, a single bag (200) may be used at tablescapes having differing drinkware requirements, thus reducing waste.

In the illustrated embodiment, various add on features may be applied alone or in combination. In one embodiment, a label may be placed on the exterior-facing side of the handle (208). In one embodiment, this label may indicate the contents of the bag (200) (e.g., "drinkware"). In some embodiments, including those described above, the materials used in rite construction of the bag (200) comprise machine-washable materials, allowing for easy washing of the bag between uses.

FIGS. 20 through 27 provide various views of a dinner plate bag according to some embodiments of the disclosure. Identification of the specific views of FIGS. 21 through 27 are provided in the Brief Description of the Drawings above and are not repeated herein. The numbering of reference numerals in FIGS. 20 through 27 is consistent, and descriptions of each element are not repeated for each Figure.

Figure 24:
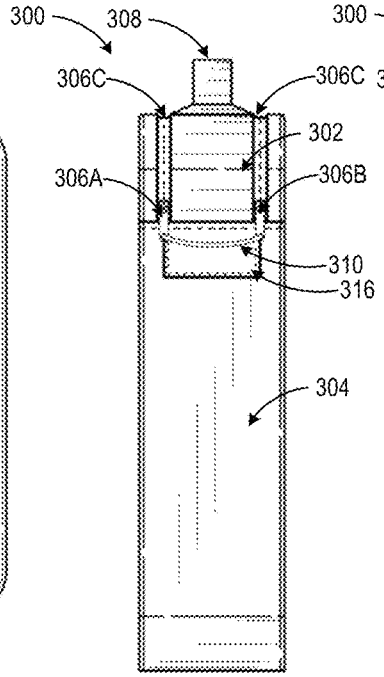
FIG. 24 is a left elevation view of a dinner plate bag according to some embodiments of the disclosure.
Figure 25:
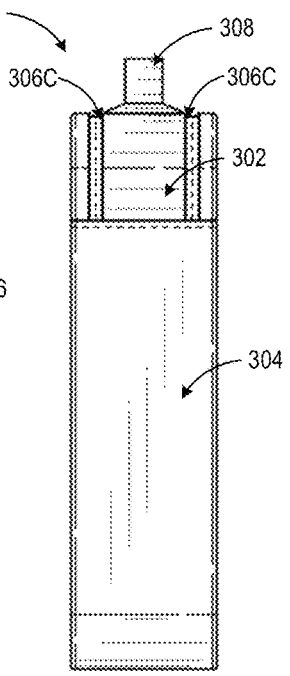
FIG. 25 is a right elevation view of a dinner plate bag according to some embodiments of the disclosure.
Figure 26:
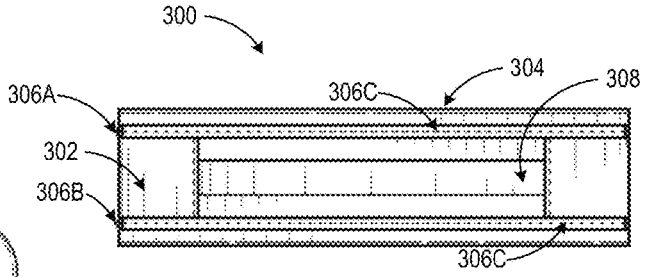
FIG. 26 is a top plan view of a dinner plate bag according to some embodiments of the disclosure.
Figure 23:
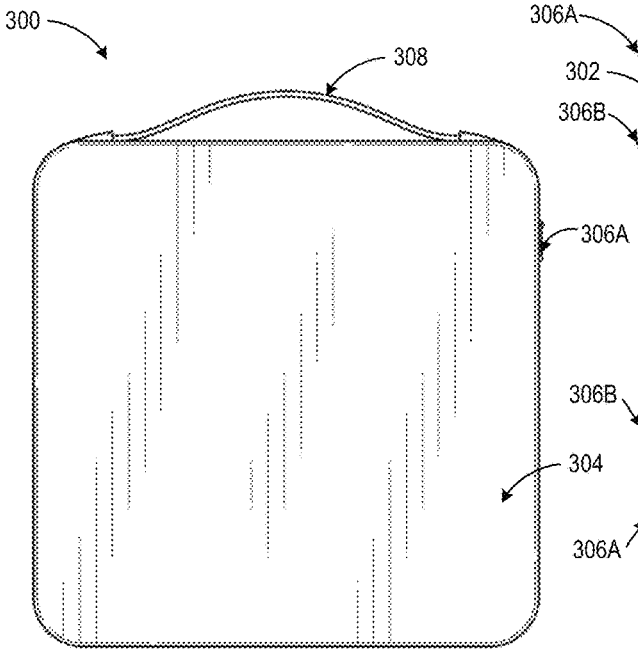
FIG. 23 is a rear elevation view of a dinner plate bag according to some embodiments of the disclosure.
Figure 27:
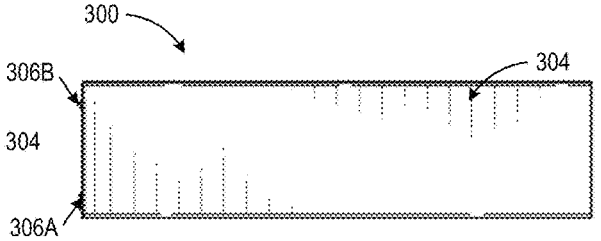
FIG. 27 is a bottom plan view of a dinner plate bag according to some embodiments of the disclosure.

In the illustrated embodiment, a dinner plate bag (300) includes a base (304) and a peel top (302) portion. In the illustrated embodiment, the bag (300) is generally cuboid in shape, although other, shapes may be implemented. The peel top (302) is connected to the base (304) on one side. For example, as illustrated in FIG. 25, one end of the peel top (302) is fixedly connected to the base (304). In one embodiment, peel top (302) and base (304) may be formed from a continuous fabric. In another embodiment, peel top (302) and base (304) may comprise separate fabric portions sewn together, as illustrated in the embodiments of FIGS. 20 through 27.

In the illustrated embodiment, the peel top (302) is connected to the base (304) via a zipper. As used herein, zipper pulls (306A, 306B) and zipper track (306C) are referred to as a zipper. In one embodiment, the zipper is configured to extend across the entire top portion of the bag (300) and ex tend across a portion of the left and right sides of the bag (300), as illustrated in FIGS. 24 and 25. In one embodiment, the zipper may only be located on the top portion of the bag (300). As illustrated, the bag (300) includes two parallel zipper tracks (306C), each connected to a zipper pull (306A, 306B). The zipper pulls (306A, 306B) are connected via crossbar (310). In some embodiments, the crossbar (310) is optional. However, when implemented, the crossbar (310) enables the simultaneous operation of zipper pulls (306A, 306B). In the illustrated embodiment, the peel top (302) includes a Velcro fastener (316) to connect the peel top (302) to the base (304).

As illustrated, the peel top (302) includes a handle (300). In the illustrated embodiment, the handle (308) enables the carrying of the bag (300) when the zipper is closed.

Figure 21:
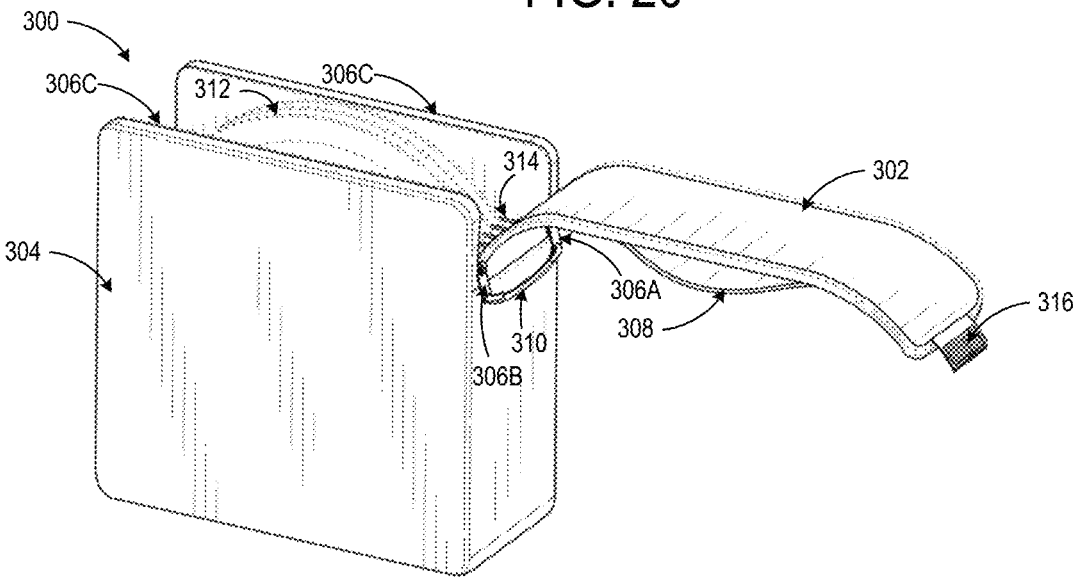
FIG. 21 is a perspective view of a dinner plate bag in a closed state according to some embodiments of the disclosure.
Figure 22:
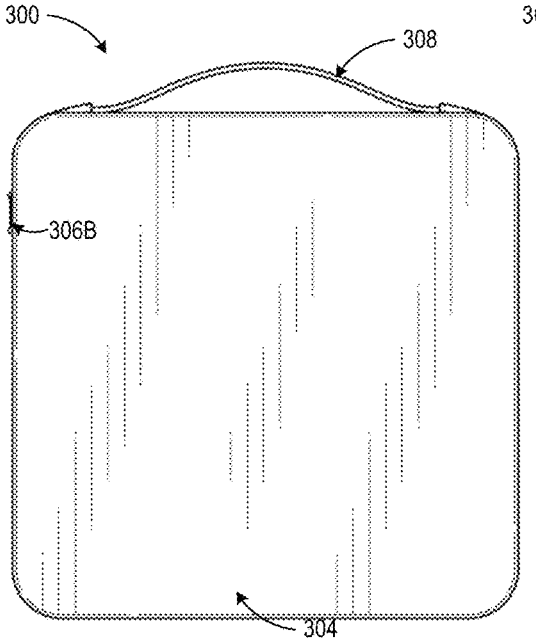
FIG. 22 is a front elevation view of a dinner plate bag according to some embodiments of the disclosure.

FIG. 21 illustrates the bag (300) in an opened state. As illustrated, the interior of the bag (300) includes an accordion separator (314). In one embodiment, the separator (314) forms a plurality of vertical slots for the insertion of elements, hi one embodiment, the number of vertical slots if four, while other embodiments may provide two or more slots. In the illustrated embodiment, each vertical slot is sized to fit a dinner plate (312). In one embodiment, the separator (314) comprises a padded separator; that is, each vertical divider of the separator comprise a padding structure.

In one embodiment, the bag (300) has dimension of 11.5"×11.5"×3"(W×H×L), although the specific measurements are not intended to be limiting.

In the illustrated embodiment, the bag (300) is made of a main fabric. In some embodiments, the main fabric comprises an eight-ounce polyester canvas. As used herein, a main fabric refers to an exterior fabric that is used to form the structure of the bag (300). The main fabric is sewn to a lining fabric. In some embodiments, the lining comprises a polyester material. In one embodiment, the lining comprises a 150-polyester material. As will be discussed, the lining may comprise the inner lining of the peel top (302) and the sidewalls and bottom of the base (304).

In the illustrated embodiment, the main fabric and the lining are sewn together to form the exterior walls of the bag (300). In some embodiments, a foam layer k inserted between the main fabric and lining prior to sewing the layers together. In one embodiment, the foam layer comprises an EPE foam layer. In some embodiments, the foam layer is eight millimeters thick. In one embodiment, the handle (308) on the surface of the peel top (302) comprises a one inch polyester strap. In some embodiments, the polyester may comprise a spun polyester strap. In some embodiments, the spun polyester comprises a spun polyester webbing. In the illustrated embodiment, the strap (308) is sewn, to the top of the peel top (302) and includes slack to form a raised portion providing a handle. In the illustrated embodiment, the zipper comprises a medium weight zipper. For example, in some embodiments, the ripper comprises a #5 nylon, zipper. In other embodiments, a #6 or #7 zipper may be used. Alternatively, or in conjunction with the foregoing, metal, coil, or molded plastic zippers may be used, in some optional embodiments, the bag (300) may additionally include ¾ inch piping along the edges of the sides.

In some embodiments, the vertical panels forming the separator (314) may be formed using woven fabric. In some embodiments, this woven fabric comprises a 100 g woven, fabric. In some embodiments, the panels additionally include an EP foam padding covered by the woven fabric. In some embodiments, this foam padding comprises a five, millimeter EPE foam padding.

In the illustrated embodiment, various add on features may be applied alone or in combination. In one embodiment, a label may be placed on the exterior-facing side of the handle (308). In one embodiment, this label may indicate the contents of the bag (300) (e.g., "dinner plates"). In some embodiments, including those described above, the materials used in the construction of the bag (300) comprise machine-washable materials, allowing for easy washing of the bag between uses.

In some embodiments, the accordion separator (314) is physically connected or attached to the interior of the base (304). That is, in one embodiment, the accordion separator (314) may be sewn to the base (304) of the bag (300). In other embodiments, however, the accordion separator (314) is optional or removable. In this embodiment, the accordion separator (314) can be removed as needed. In these embodiments. Velcro fasteners may be used to secure the accordion separator (314) to the base (304). In these embodiments, Velcro may be placed on the sides and bottom of the base (304) and the corresponding faces of the accordion separator (314). In some embodiments, 1-inch Velcro strips may be used.

In one embodiment, the handle (308) comprises a ⅜-inch polyester strap. In some embodiments, the polyester of the handle (308) may comprise a spun polyester strap. In some embodiments, the spun polyester of the handle (308) comprises a spun polyester webbing.

FIGS. 28 through 35 provide various views of a salad plate bag according to some embodiments of the disclosure. Identification of the specific views of FIGS. 28 through 35 are provided in the Brief Description of the Drawings above and are not repeated herein. The numbering of reference numerals in FIGS. 28 through 35 is consistent, and descriptions of each element are not repeated for each Figure.

Figure 32:
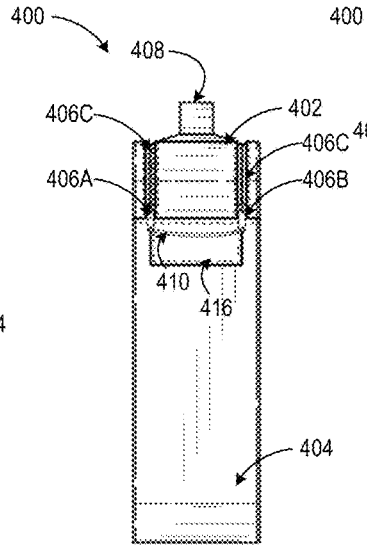
FIG. 32 is a left, elevation view of a salad plate bag according to some embodiments of the disclosure.
Figure 33:
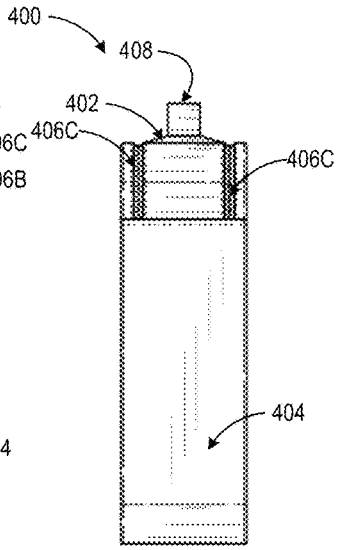
FIG. 33 is a right elevation view of a salad plate bag according to some embodiments of the disclosure.
Figure 31:
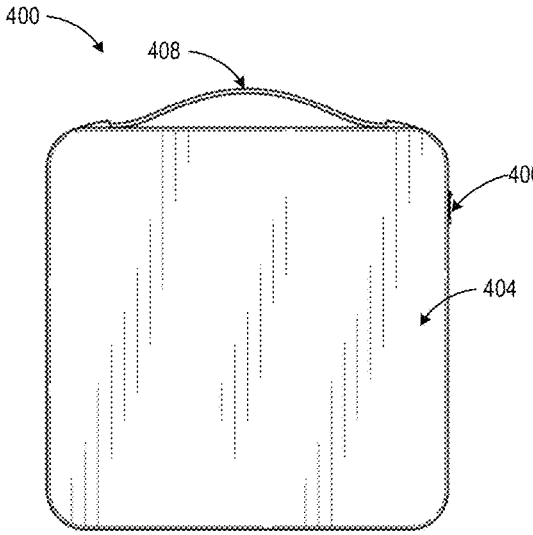
FIG. 31 is a rear elevation view of a salad plate bag according to some embodiments of the disclosure.
Figure 34:
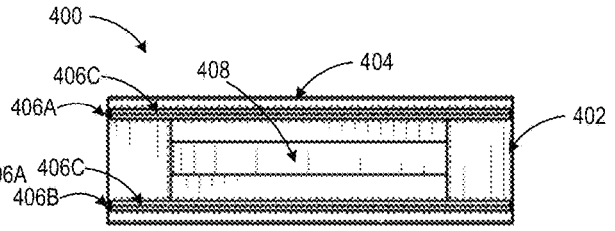
FIG. 34 is a top plan view of a salad plate bag according to some embodiments of the disclosure.
Figure 35:
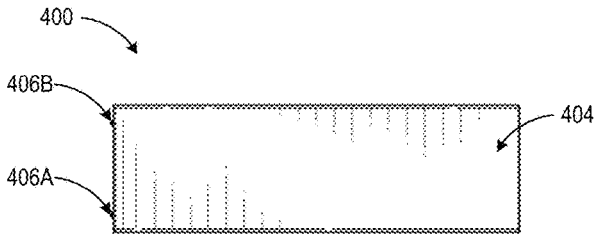
FIG. 35 is a bottom plan view of a salad plate bag according to some embodiments of the disclosure.

In the illustrated embodiment, a salad plate bag (400) includes a base, (404) and aped top (402) portion. In the illustrated embodiment, the bag (400) is generally cuboid its shape, although other shapes may be implemented. The peel top (402) is connected to the base (404) on one side. For example, as illustrated in FIG. 33, one end of the peel top (402) is fixedly connected to the base (404). In one embodiment, peel top (402) and base (404) may be formed from a continuous fabric. In another embodiment, peel top (402) and base (404) may comprise separate fabric portions sewn together, as illustrated in rise embodiments of FIGS. 28 through 35.

In the illustrated embodiment, the peel top (402) is connected to the base (404) via a zipper. As used herein, zipper pulls (406A, 406B) and zipper track (406C) are referred to as a zipper, in one embodiment, the zipper is configured to extend across the entire top portion of the bag (400) and extend across a portion of the left and right sides of the bag (400), as illustrated in FIGS. 32 and 33. In one embodiment, the zipper may only be located on the top portion of the bag (400). As illustrated, the bag (400) includes two parallel zipper tracks (406C), each connected to a zipper poll (406A, 406B). The zipper polls (406A, 406B) are connected via crossbar (410). In some embodiments, the crossbar (410) is optional. However, when implemented, the crossbar (410) enables the simultaneous operation of zipper pulls (406A, 406B). In the illustrated embodiment, the peel top (402) includes a Velcro fastener (416) to connect the peel top (402) to the base (404).

A illustrated, the peel top (402) includes a handle (408). In the illustrated embodiment, the handle (408) enables the carrying of the bag (400) when the zipper is closed.

Figure 28:
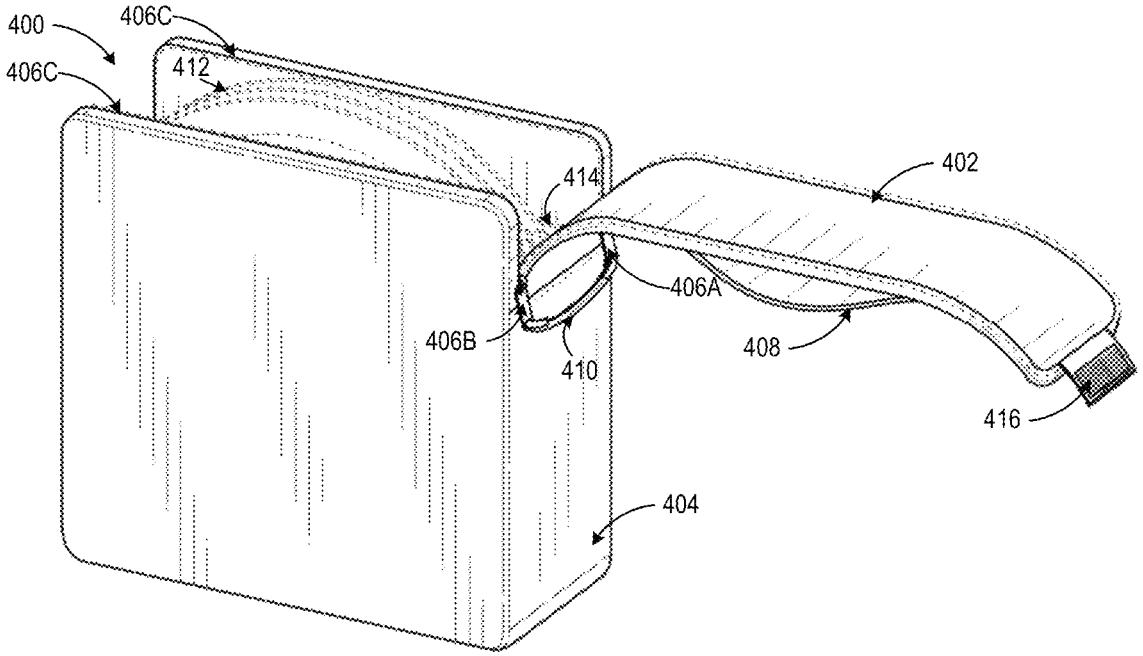
FIG. 28 is a perspective view of a salad plate bag in an opened state according to some embodiments of the disclosure.
Figure 29:
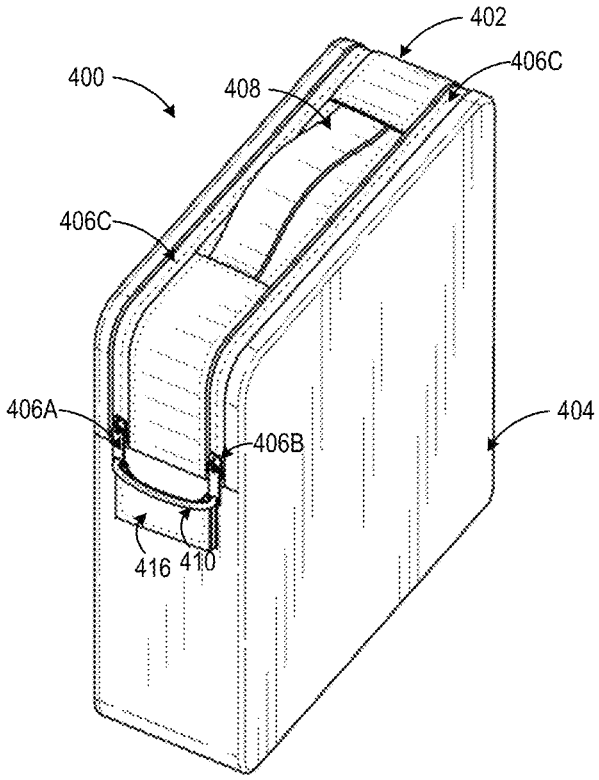
FIG. 29 is a perspective view of a salad plate bag in a closed state according to some embodiments of the disclosure.
Figure 30:
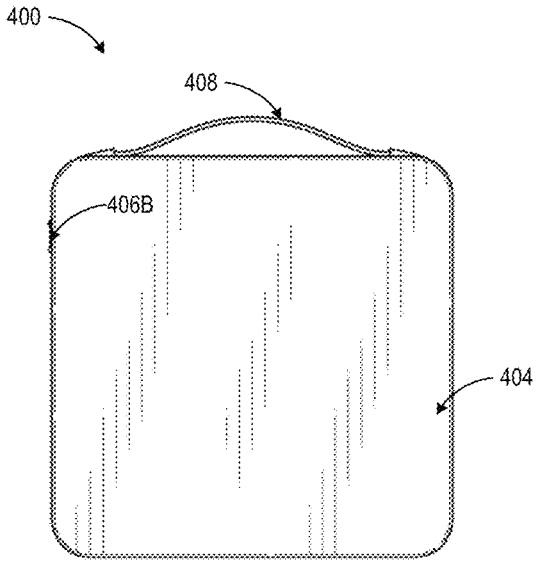
FIG. 30 is a front, elevation view of a salad plate bag according to some embodiments of the disclosure.

FIG. 28 illustrates the bag (400) in an opened state. A illustrated, the interior of the bag (400) includes an accordion separator (414). In one embodiment, the separator (414) forms a plurality of vertical slots for the insertion of elements. In one embodiment, the number of vertical slots if four, while other embodiments may provide two or more slots. In the illustrated embodiment, each vertical slot is sized to fit a salad plate (412). In one embodiment, the separator (414) comprises a padded separator; that is, each vertical divider of the separator comprises a padding structure.

In one embodiment, the bag (400) has dimensions of 9.5"×9.5"×3"(W×H×L), although the specific measurements are not intended to be limiting.

In the illustrated embodiment, the bag (400) is made of a main, fabric. In some embodiments, the main fabric comprises an eight-ounce polyester canvas. As used herein, a main fabric refers to an exterior fabric that is used to form the structure of the bag (400). The main fabric is sewn to a lining fabric. In some embodiments, the lining comprises a polyester material. In one embodiment, the lining comprises a 150-polyester material. As will be discussed, the lining may comprise the inner lining of the peel top (402) and the sidewalls and bottom of the base (404).

In the illustrated embodiment, the main fabric and the lining are sewn together to form the exterior walls of the bag (400). In some embodiments, a foam layer is inserted between the main fabric and lining prior to sewing the layers together. In one embodiment, the foam layer comprises an EPE foam layer. In some embodiments, the foam layer is eight millimeters thick. In one embodiment, the handle (408) on the surface of the peel top (402) comprises a one-inch polyester strap. In some embodiments, the polyester may comprise a spun polyester strap. In some embodiments, the spun polyester comprises a spun polyester webbing. In the illustrated embodiment, the strap (408) is sewn to the top of the peel top (402) and includes slack to form a raised portion providing a handle. In the illustrated embodiment, the zipper composes a medium weight zipper. For example, Its some embodiments, the zipper comprises a #5 nylon zipper. In other embodiments, a #6 or #7 zipper may be used. Alternatively, or in conjunction with the foregoing, metal, coil, or molded plastic zippers may be used. In some optional embodiments, the bag (400) may additionally include ¾ inch piping along the edges of the sides.

Its some embodiments, the vertical panels forming the separator (414) may be formed using woven fabric. In some embodiments, this woven fabric comprises a 100 g woven fabric, in some embodiments, the panels additionally include an EP loans padding coveted by the woven fabric. Its some embodiments, das foam padding comprises a five-millimeter EPE foam padding.

In the illustrated embodiment, various add on features may be applied alone or in combination. In one embodiment, a label may be placed on the exterior-facing side of the handle (408). In one embodiment, this label may indicate the contents of the bag (400) (e.g., "salad plates"). In some embodiments, including those described above, the materials used its the construction of the bag (400) comprise machine-washable materials, allowing for easy washing of the bag between uses.

In some embodiments, the accordion separator (414) is physically connected or attached to the interior of the base (404). That is, in one embodiment, the accordion separator (414) may be sewn to rise base (404) of the bag (400). In other embodiments, however, the accordion separator (414) is optimal or removable. In this embodiment, the accordion separator (414) can be removed as needed. In these embodiments, Velcro fasteners may be used to secure the accordion separator (414) to the base (404). In these embodiments, Velcro may be placed on the sides and bottom of the base (404) and the corresponding faces of the accordion separator (414). In some embodiments, 1-inch Velcro strips may be used.

In one embodiment, the handle (408) comprises a ⅜-inch polyester strap. In some embodiments, the polyester of the handle (408) may comprise a spun polyester strap. In some embodiments, the spun polyester of the handle (408) comprises a spun polyester webbing.

FIGS. 36 through 41 provide various views of a silverware roll bag according to some embodiments of the disclosure. Identification of the specific views of FIGS. 36 through 41 are provided in the Brief Description of the Drawings above and are not repeated herein. The numbering of reference numerals in FIGS. 36 through 41 is consistent and descriptions of each element are not repeated for each figure.

In the illustrated embodiment, the silverware, roll bag (500) includes a main panel (504) and a flap (502). In the illustrated embodiment, the flap (502) is connected to the main panel (504) on one side and is configured to cover silverware (310) inserted into an array of slots (506*a*, 506*b*). The bag (500) additionally includes a tie (508) that can be used to secure the bag (500) when it is in a rolled state (as illustrated in FIGS. 37 through 41). As illustrated, the first, set of slots (506*a*) may comprise slots sized to hold silverware while the second set of slots (506*b*) comprise larger slots.

In the illustrated embodiment, the bag (500) is made of a main fabric. In some embodiments, the main fabric comprises an eight-ounce polyester canvas. The main fabric is sewn to a lining fabric. In some embodiments, the lining comprises a polyester material. In one embodiment, the lining comprises a 150-polyester material. In the illustrated embodiment, the lining comprises an internal surface when rolled.

In the illustrated embodiment, the main fabric and the lining are sewn together to form the bag (500). In some embodiments, a foam layer is inserted between the main fabric and lining prior to sewing the layers together. In one embodiment, the foam layer comprises a sponge loam layer. In some embodiments, the foam layer is one millimeter thick. In some embodiments, the lining of the flap (502) may alternatively comprise a velvet fabric. In some embodiments, the padding of the flap (502) may be different dun the padding of the main panel (504). In these embodiments, the padding can comprise a woven fabric, such as a 100 g woven fabric. In some embodiments, the tie may comprise a spun polyester strap. In some embodiments, the spun polyester comprises a spun polyester webbing. In some optional embodiments, the bag (500) may additionally include ¾ inch piping along the edges of the sides.

Figure 36:
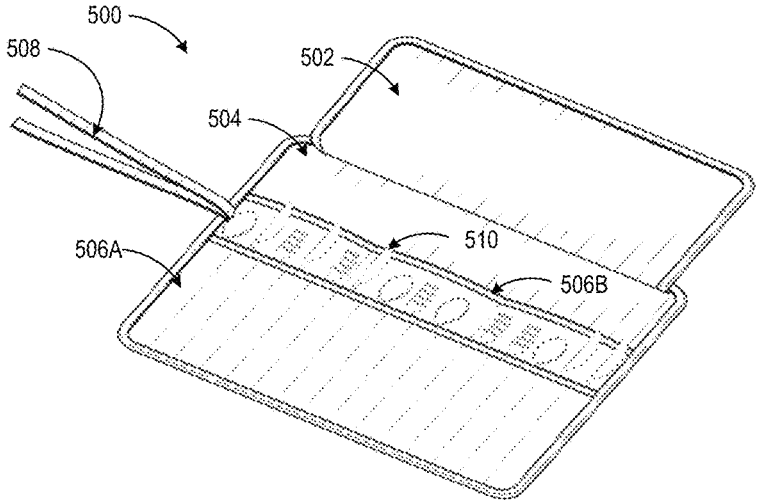
FIG. 36 is a perspective view of a silverware roll bag in an unrolled state according to some embodiments of the disclosure.
Figure 37:
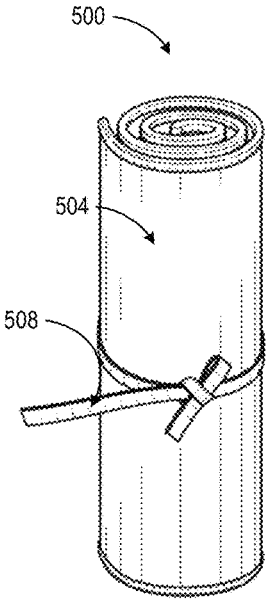
FIG. 37 is a perspective view of a silverware rot) bag in a rolled state according to some embodiments of the disclosure.
Figure 38:
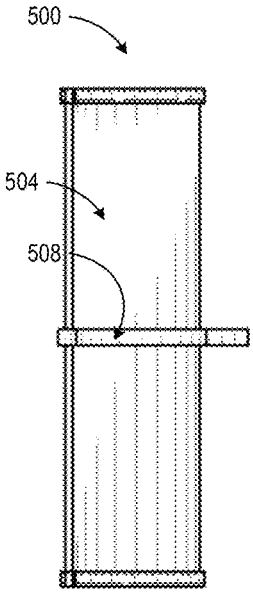
FIG. 38 is a front elevation view of a silverware roll bag according to some embodiments of the disclosure.
Figure 39:
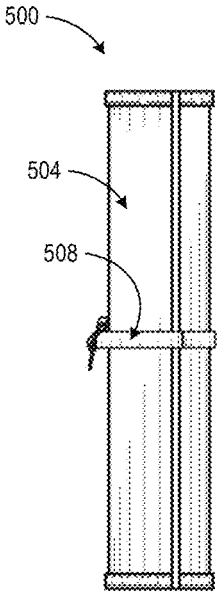
FIG. 39 is a mar elevation view of a silverware roll bag according to some embodiments of the disclosure.
Figure 40:
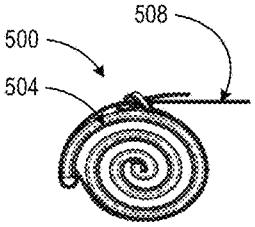
FIG. 40 is a left elevation view of a silverware roll bag according to some embodiments of the disclosure.
Figure 41:
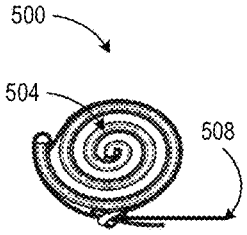
FIG. 41 is a right elevation view of a silverware roll bag according to some embodiments of the disclosure.
Figure 42:
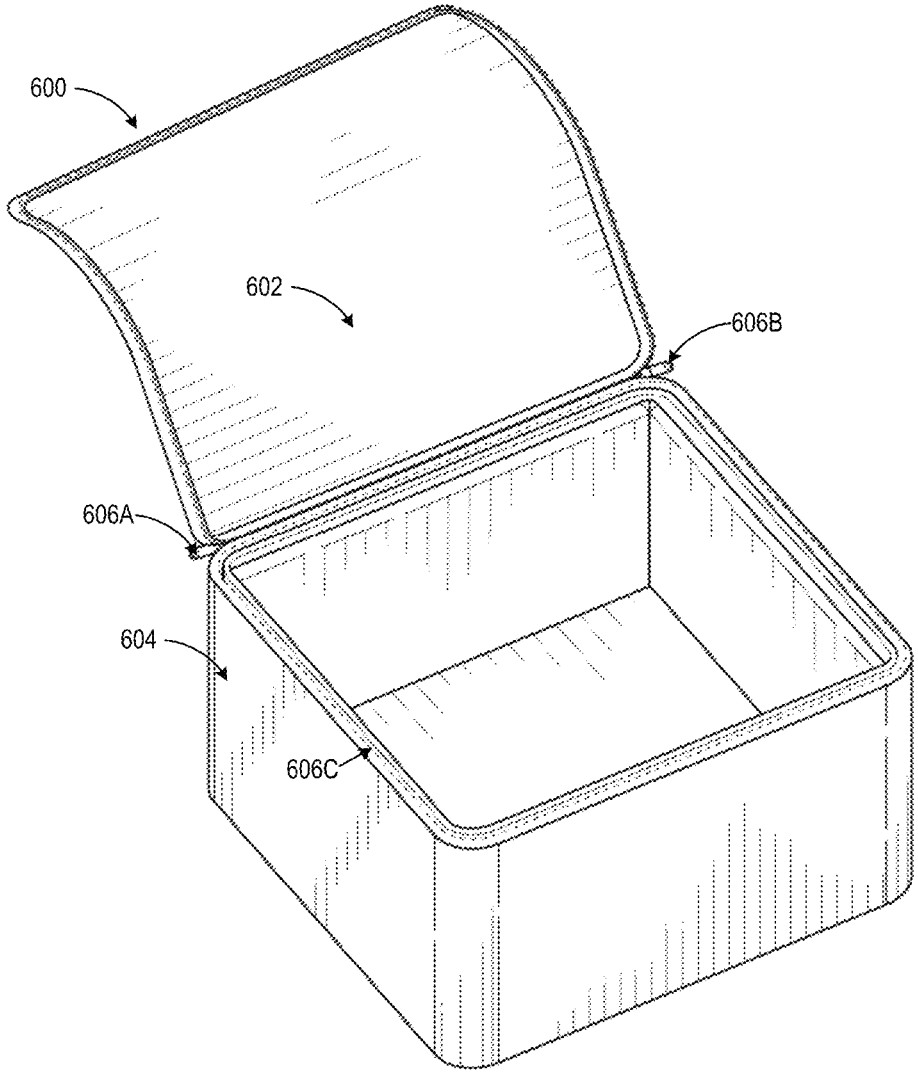
FIG. 42 is a perspective view of a décor bag in an opened state according to some embodiments of the disclosure.
Figure 43:
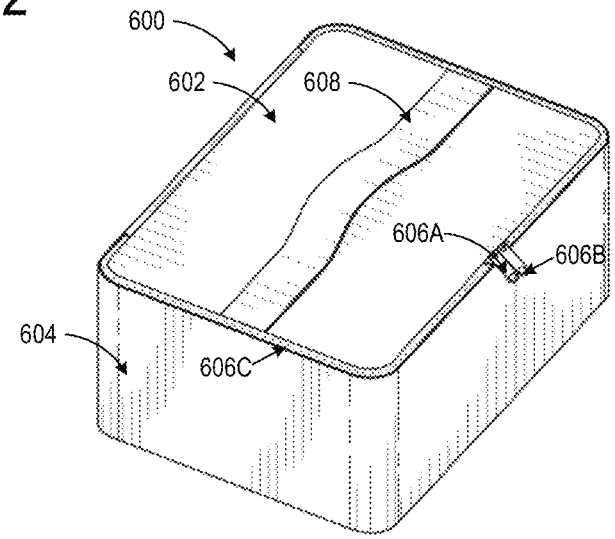
FIG. 43 is a perspective view of a décor bag in a closed state according to some embodiments of the disclosure.
Figure 44:
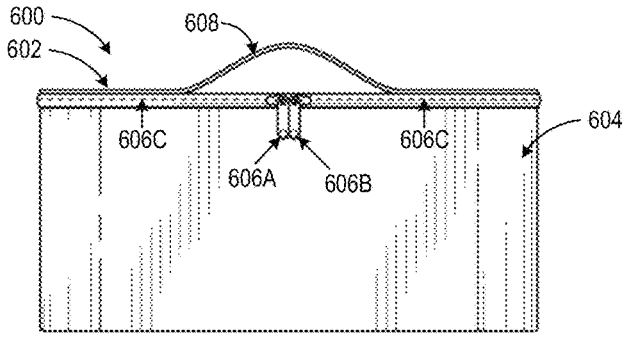
FIG. 44 is a front elevation view of a décor bag according to some embodiments of the disclosure.
Figure 46:
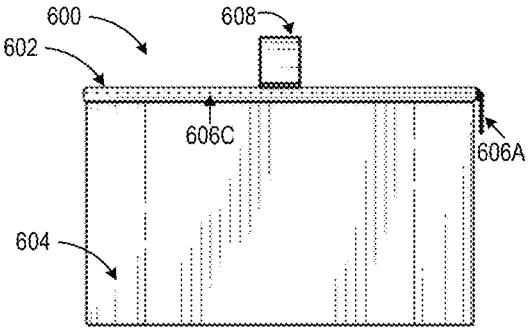
FIG. 46 is a left elevation view of a décor bag according to some embodiments of the disclosure.
Figure 45:
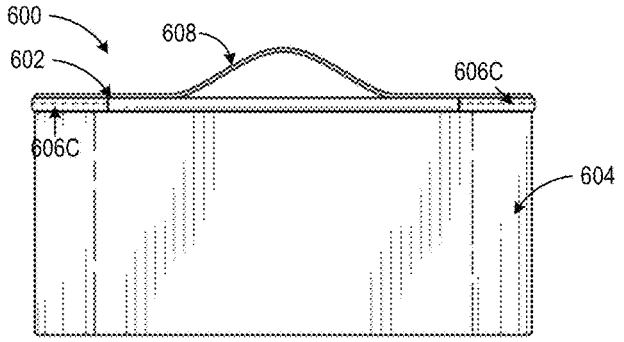
FIG. 45 is a rear elevation view of a décor bag according to some embodiments of the disclosure.
Figure 47:
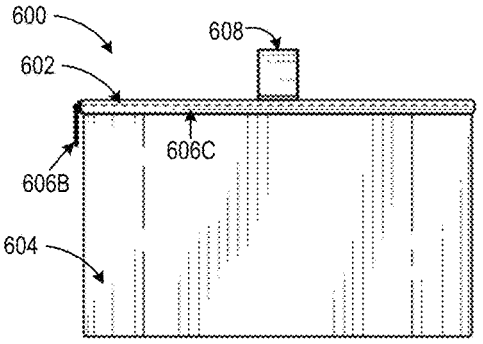
FIG. 47 is a right elevation view of a décor bag according to some embodiments of the disclosure.
Figure 48:
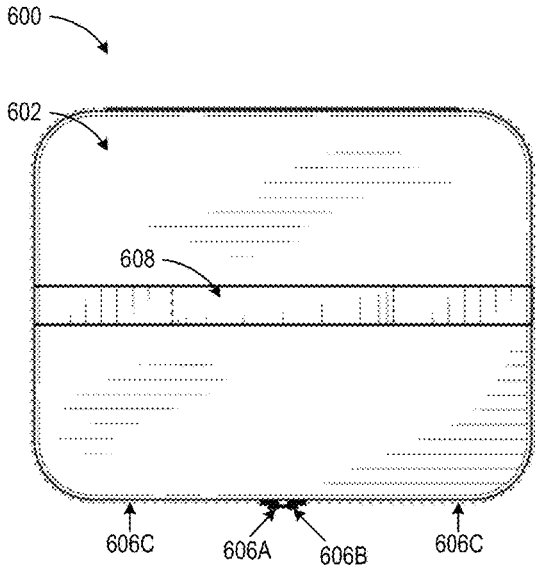
FIG. 48 is a top plan view of a décor bag according to some embodiments of the disclosure.
Figure 49:
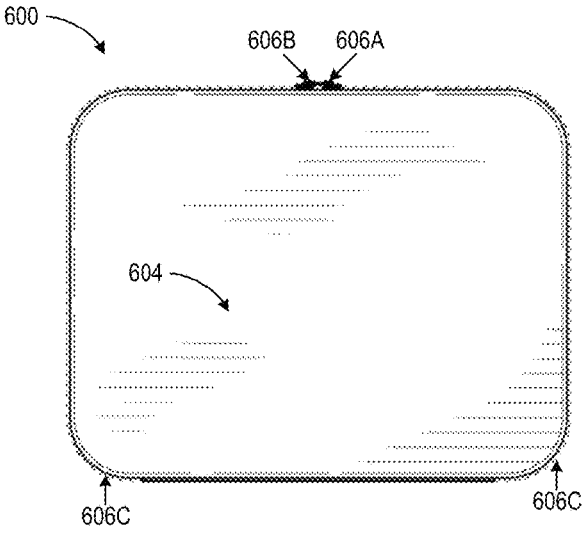
FIG. 49 is a bottom plan view of a décor bag according to some embodiments of the disclosure.
Figure 50:
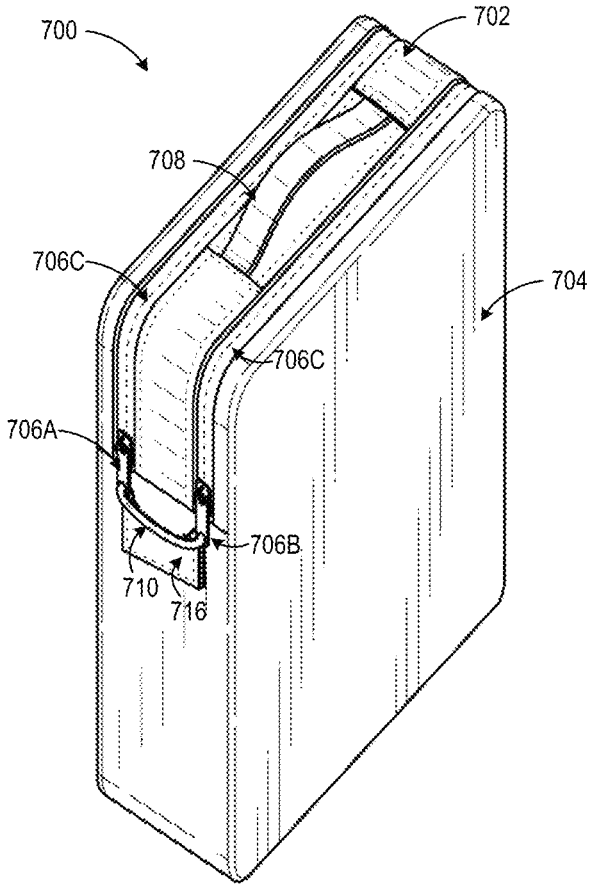
FIG. 50 is a perspective, view of an auxiliary bag in an opened state according to some embodiments of the disclosure.

In one embodiment, the bag (500) has dimensions of 15.75"×11.5" when unrolled (FIG. 36). In some embodiments, when rolled (FIGS. 37-40), the bag (500) may have dimensions of 11.5"×3". Specific measurements are not intended to be limiting. In some embodiments, the tie (508) may comprise a loop tie. In other embodiments, the he may comprise two long fabrics that may be tied in a knot. In some embodiments, the bag (500) may include a label indicating the contents of the bag (500) (e.g., "silverware").

FIGS. 42 through 49 provide various views of a décor bag according to some embodiments of the disclosure. Identification of the specific views of FIGS. 42 through 49 are provided in the Brief Description of the Drawings above and are not repeated herein. The numbering of reference numerals in FIGS. 42 through 49 is consistent, and descriptions of each element are not repeated for each Figure.

In the illustrated embodiment, a décor bag (600), alternatively referred to as a "sub container," comprises a lid (602) connected to a base (604) via a zipper, the zipper comprising a track (606*c*) and a plurality of zipper pulls (606*a*, 206*b*). As used herein, zipper pulls (606*a*, 206*b*) and zipper track (606*c*) are referred to as a zipper. The lid (602) and base (604) are formed as a single fabric container with hinge portions on the backside of the bag (600). In one embodiment, the bag (600) has dimensions of 9"χ6"×11.5" (W×H×L), although the specific measurements are not intended to be limiting. As illustrated in FIGS. 43-48, the lid (602) may additionally include a handle (608) situated in the middle of the lid (602).

In the illustrated embodiment, the bag (600) is made of a main fabric. In some embodiments, the main fabric comprises an eight-ounce polyester canvas. As used herein, a main fabric refers to an exterior fabric that is used to form the structure, of the bag (600). The main fabric is sewn to a lining fabric. In some embodiments, the lining comprises a polyester material. In one embodiment, the lining comprises a 150-polyester material. As will be discussed, the lining may comprise the inner lining of the lid (602) and the sidewalls and bottom of the base (604).

In the illustrated embodiment, the main fabric and the lining are sewn together to form the exterior walls of the bag (600). In some embodiments, a foam layer is inserted between the main fabric anti lining prior to sewing the layers together. In one embodiment, the foam layer comprises an EPE foam layer. In some embodiments, the foam layer is ten millimeters thick. In one embodiment, the handle (608) on the surface of the lid (602) comprises a one-inch polyester strap. In some embodiments, the polyester may comprise a spun polyester strap. In some embodiments, the spun polyester comprises a spun polyester webbing. In the illustrated embodiment, the strap (608) is sewn to the top of the lid (602) and includes slack to form a raised portion providing a handle. In the illustrated embodiment, the zipper comprises a medium weight zipper. For example, in some embodiments, the zipper comprises a #5 nylon zipper. In other embodiments, a #6 or #7 zipper may be used. Alternatively, or in conjunction with the foregoing, metal, coil, or molded plastic, zippers may be used. In some optional embodiments, the bag (600) may additionally include ¾ inch piping along the edges of the sides.

In the illustrated embodiment, various add on features may be applied alone or in combination. In one embodiment, a label may be placed on the exterior-facing side of the handle (608), In one embodiment, this label may indicate the contents of the bag (600) (e.g., "décor"). In some embodiments, including those described above, the materials used in the construction of the bag (600) comprise machine-washable materials, allowing for easy washing of the bag between uses.

FIGS. 50 through 57 provide various views of an auxiliary bag according to some embodiments of the disclosure. Identification of the specific views of FIGS. 50 through 57 are provided in the Brief Description of the Drawings above and are not repeated herein. The numbering of reference numerals in FIGS. 50 through 57 is consistent, and descriptions of each element are nor repeated for each Figure.

In the illustrated embodiment, an auxiliary bag (700) includes a base (704) and a peel top (702) portion. In the illustrated embodiment, the bag (700) is generally cuboid in shape, although other shapes may be implemented. The peel top (702) is connected to rite base (704) on one side. For example, as illustrated in FIG. 25, one end of the peel top (702) is fixedly connected to the base (704). In one embodiment, peel top (702) and base (704) may be formed from a continuous fabric. In another embodiment, peel top (702) and base (704) may comprise separate fabric portions sewn together, as illustrated in the embodiments of FIGS. 50 through 57.

Figure 54:
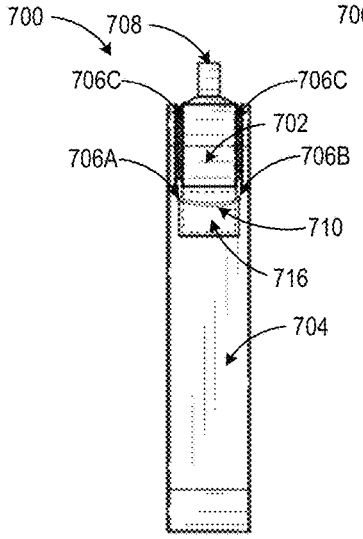
FIG. 54 is a left deration view of an auxiliary bag according to some embodiments of the disclosure.
Figure 55:
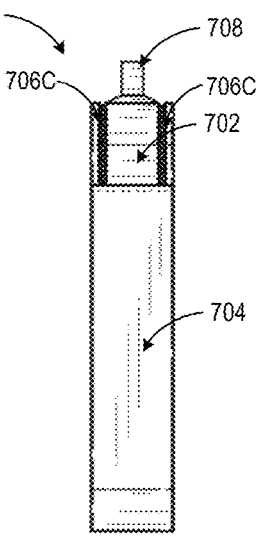
FIG. 55 is a right elevation view of an auxiliary bag according to some embodiments of the disclosure.
Figure 53:
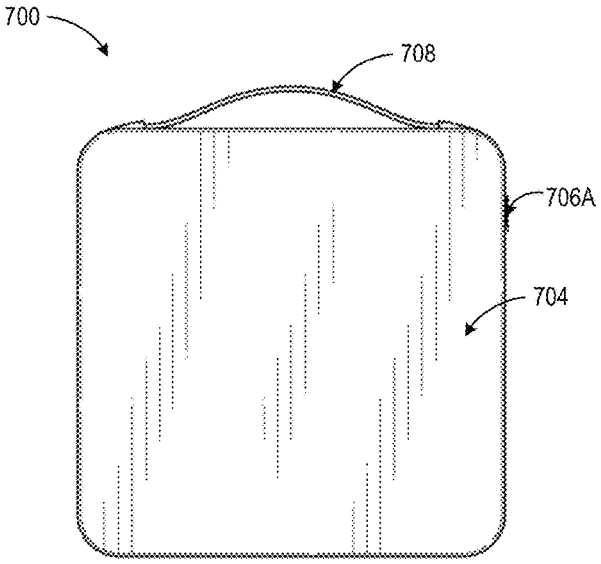
FIG. 53 is a rear elevation view of an auxiliary bag according to some embodiments of the disclosure.
Figure 56:
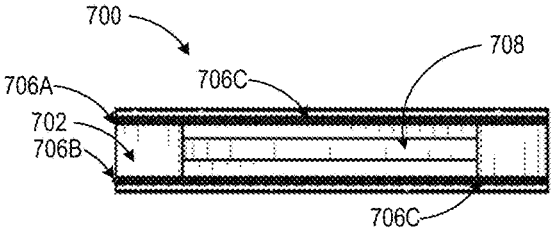
FIG. 56 is a top plan view of an auxiliary bag according to some embodiments of the disclosure.
Figure 57:
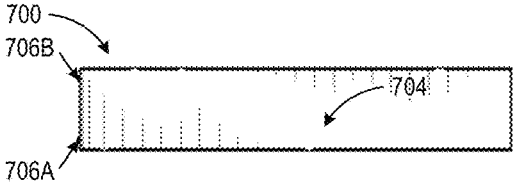
FIG. 57 is a bottom plan new of an auxiliary bag according to some embodiments of the disclosure.

In the illustrated embodiment, the peel top (702) is connected to the base (704) via a zipper. As used herein, zipper pulls (706A, 706B) and zipper track (706C) are referred to as a zipper. In one embodiment, the zipper is configured to extend across the entire top portion of the bag (700) and extend across a portion of the left and right sides of the bag (700), as illustrated in FIGS. 54 and 55. In one embodiment, the zipper may only be located on the top portion of the bag (700). As illustrated, the bag (700) includes two parallel zipper tracks (706C), each connected to a zipper pull (706A, 706B). The zipper pulls (706A, 706B) are connected via crossbar (710). In some embodiments, the crossbar (710) is optional. However, when implemented, the crossbar (710) enables the simultaneous operation of zipper pulls (706A, 706B). In the illustrated embodiment, the peel top (702) includes a Velcro fastener (716) to connect the peel top (702) to the base (704).

As illustrated, the peel top (702) includes a handle (708). In the illustrated embodiment, the handle (708) enables the carrying of the bag (700) when the zipper is closed.

Figure 51:
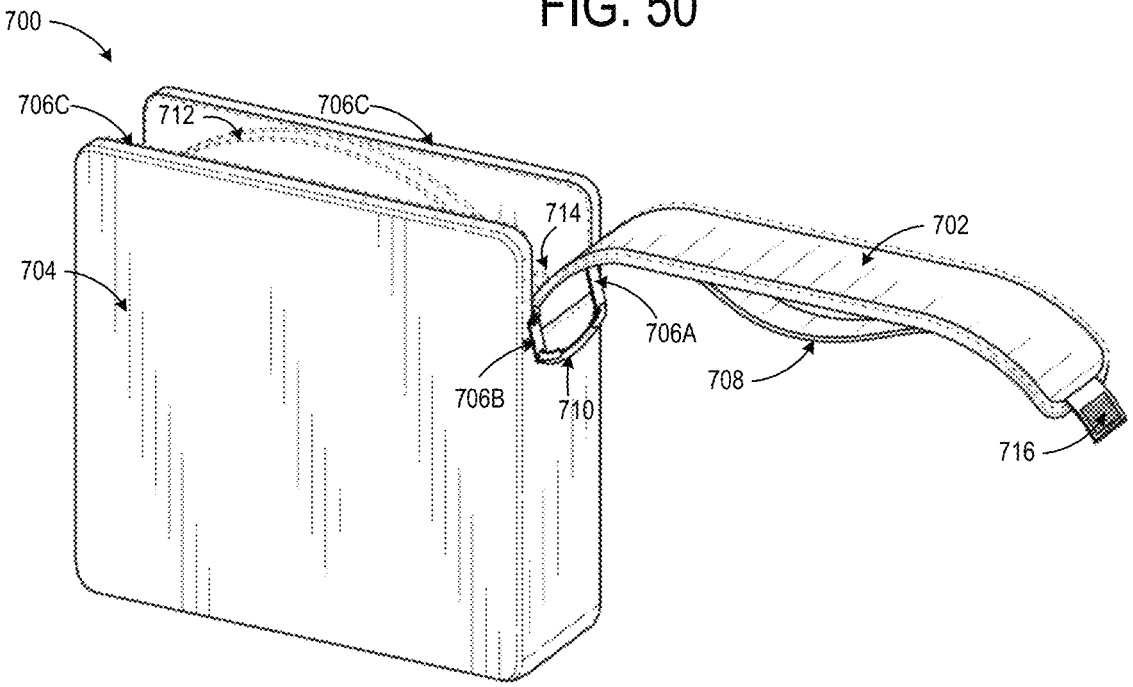
FIG. 51 is a perspective view of an auxiliary bag in a closed, stare according to some embodiments of the disclosure.
Figure 52:
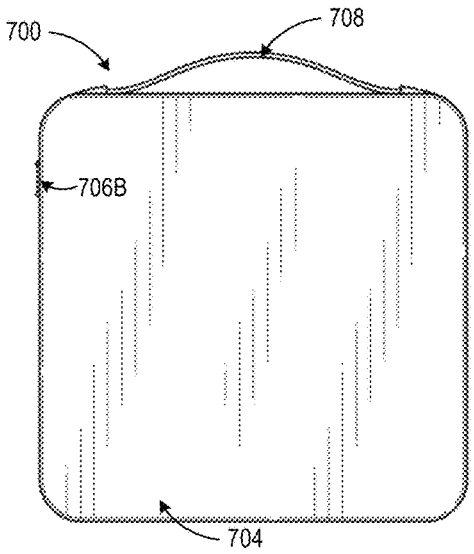
FIG. 52 is a front elevation view of an auxiliary bag according to some embodiments of the disclosure.

FIG. 51 illustrates the bag (700) in an opened state. As illustrated, the interior of the bag (700) includes one separator (714). In one embodiment, the separator (714) forms two vertical slots for the insertion of elements. In the illustrated embodiment, each vertical slot is sized to fit a dinner plate (712) or a salad plate (712). In one embodiment, the separator (714) comprises a padded, separator; that is, the vertical divider of the separator comprises a padding structure. In the illustrated embodiment, the bag (700) may be used to store auxiliary or supplementary items in the event of damage during shipping.

In the illustrated embodiment, the bag (700) is made of a main fabric. In some embodiments, the main fabric composes an eight-ounce polyester canvas. As used herein, a main fabric refers to an exterior fabric that is used to form the structure of the bag (700). The main fabric is sewn to a lining fabric. In some embodiments, the lining comprises a polyester material. In one embodiment, the lining comprises a 150-polyester material. As will be discussed, the lining may comprise the inner lining of the peel top (702) and the sidewalls and bottom of the base (701).

In the illustrated embodiment, the main fabric, and the lining are sewn together to form the exterior walls of the bag (700). In some embodiments, a foam layer is inserted between the main fabric and lining prior to sewing the layers together. In one embodiment, the foam layer comprises an EPE foam layer. In some embodiments, the foam layer is eight millimeters thick. In one embodiment, the handle (708) on the surface of the peel top (702) composes a one-inch polyester strap. In some embodiments, the polyester may comprise a spun polyester strap. In some embodiments, the spun polyester comprises a spun polyester webbing. In the illustrated embodiment, the soap (708) is sewn to the top of the peel top (702) and includes slack to form a raised portion providing a handle. In the illustrated embodiment, the zipper comprises a medium weight zipper. For example, in some embodiments, the zipper comprises a #5 nylon zipper. In other embodiments, a #6 or #7 zipper may be used. Alternatively, or in conjunction with the foregoing, metal, coil, or molded plastic zippers may be used. In some optional embodiments, the bag (700) may additionally include ¾ inch piping along the edges of the sides.

In some embodiments, the vertical panels forming the separator (714) may be formed using woven fabric. In some embodiments, this woven fabric comprises a 100 g woven fabric. In some embodiments, the panels additionally include an EP foam padding covered by the woven fabric. In some embodiments, this foam padding comprises a five-millimeter EPE foam padding.

In the illustrated embodiment, various add on features may be applied alone or in combination. In one embodiment, a label may be placed on the exterior-facing side of the handle (708). In one embodiment, this label may indicate the contents of the bag (700) (e.g., "just in case" or "auxiliary"). In some embodiments, including those described above, the materials used in the construction of the bag (700) comprise machine-washable materials, allowing for easy washing of the bag between uses.

In some embodiments, the separator (714) is physically connected or attached to the interior of the base (704). That is, in one embodiment, the separator (714) may be sewn, to the base (704) of the bag (700). In other embodiments, however, the separator (714) is optional or removable. In this embodiment, the separator (714) can be removed as needed. In these embodiments. Velcro fasteners may be used to secure the separator (714) to the base (704). In these embodiments. Velcro may be placed on the sides and bottom of the base (704) and the corresponding laces of the separator (714). In some embodiments, 1-inch Velcro strips may be used.

In one embodiment, the handle (708) comprises a ⅜-inch polyester strap. In some embodiments, the polyester of the handle (708) may comprise a spun polyester strap. In some embodiments, the spun polyester of the handle (708) comprises a spun polyester webbing.

It should be noted that although embodiments are described that include specific dimensions and/or material thicknesses, those metrics should not be construed as limiting. Indeed, various dimensions and thicknesses may be implemented based on the needs of the case and the various sub-containers or based on shipping conditions.

Subject matter has been described with reference to the accompanying drawings which show illustrative embodiments. Subject matter can, however, be embodied in a variety of different forms and the claimed subject matter is intended to be construed as not being limited to any example embodiments. Likewise, a reasonably broad scope for claimed or covered subject matter is intended.

In general, terminology can be understood at least in part from usage in context. For example, terms, such as "and", "or", or "and/or," as used herein can include a variety of meanings that can depend at least in part upon the context in winch such terms are used. Typically, "or," if used to associate a list, such as A, B or C, is intended to mean A, B, and C, here used in the inclusive sense, as well as A, B or C, here used in the exclusive sense. Also, the term "one or more" as used herein, depending at least in part upon context, can be used to describe any feature, structure, or characteristic in a singular sense or can be used to describe combinations of features, structures or characteristics in a plural sense. Similarly, terms, such as "a," "an," or "the," again, can be understood to convey a singular usage or to convey a plural usage, depending at lease in part upon context. Also, the term "based on" can be understood as not necessarily intended to convey an exclusive set of factors and can, instead, allow for the existence of additional factors not necessarily expressly described, again, depending at least in part on context.

What is claimed is:

1. A device comprising:

a set of tablescape items, the set of tablescape items including plates, drinkware, and silverware;

a hardshell case, the hardshell case comprising a lid and base, the hardshell case including a rigid exterior and a padded interior wherein the lid includes a cavity formed via a lid flap present on the interior side of the lid, the lid flap connected to the lid via a zipper; and a plurality of modular containers for storing the tablescape items, the plurality of modular containers configured to be inserted into a cavity in the base, wherein when inserted the plurality of modular containers occupy substantially all available space in the cavity, and wherein each of the plurality of modular containers is sized based on a type of the tablescape items stored therein.

2. The device of claim 1, wherein the rigid exterior is formed from a material suitable for commercial shipping.

3. The device of claim 2, wherein the rigid exterior comprises acrylonitrile butadiene styrene.

4. The device of claim 1, wherein the padded interior comprises foam padding.

5. The device of claim 4, wherein the foam padding comprises 1-inch foam padding in the base and ½-inch foam padding in the lid.

6. The device of claim 1, further comprising two handles on opposite sides of the hardshell case.

7. The device of claim 1, wherein the lid flap further includes one or more pockets.

8. The device of claim 1, further comprising a zipper connecting the lid and base.

9. The device of claim 1, wherein the lid further comprises a debossed area on the exterior facing side of the lid, the debossed area sized to house a shipping label.

10. A device comprising:

a set of tablescape items, the set of tablescape items including plates, drinkware, and silverware;

a hardshell case, the hardshell case comprising a lid and base, the hardshell case including a rigid exterior and a padded interior; and a plurality of modular containers for storing the tablescape items, the plurality of modular containers configured to be inserted into a cavity in the base, wherein when inserted the plurality of modular containers occupy substantially all available space in the cavity, and wherein each of the plurality of modular containers is sized based on a type of the tablescape items stored therein, wherein the plurality of modular containers includes a drinkware bag for storing the drinkware, a dinner plate bag for storing a first set of the plates, a salad plate bag for storing a second set of the plates wherein the second set of plates are smaller than the first set of plates, and a silverware roll bag for storing the silverware.

11. The device of claim 10, further comprising a décor bag inserted on the bottom of the cavity and against a first sidewall of the cavity, the décor bag having a depth substantially equal to the depth of the cavity.

12. The device of claim 11, wherein the drinkware bag is inserted atop the décor bag and against the first sidewall of the cavity, the drinkware bag having a depth substantially equal to the depth of the cavity.

13. The device of claim 12, wherein the dinner plate bag is inserted on the bottom of the cavity and against a second sidewall of the cavity, the second sidewall located opposite the first sidewall, the dinner plate bag having a depth substantially equal to the depth of the cavity.

14. The device of claim 13, wherein the salad plate bag is inserted between the dinner plate bag and a stacked combination of the décor bag and drinkware bag.

15. The device of claim 14, wherein the silverware roll bag is inserted between the dinner plate bag and décor bag and adjacent to the salad plate bag.

16. The device of claim 15, further comprising an auxiliary bag, the auxiliary bag inserted between the dinner plate bag and salad plate bag.

17. The device of claim 10, wherein the drinkware bag includes an internal divider, the internal divider being removable from the drinkware bag.

18. The device of claim 10, wherein the drinkware bag, décor bag, dinner plate bag, and salad plate bag each include at least one zipper.

19. The device of claim 10, wherein the drinkware bag, décor bag, dinner plate bag, salad plate bag, and silverware roll bag each include padding, the padding comprising a material selected such the padding is thinner than padding present in the padded interior.

* * * * *